US005384634A

United States Patent [19]

Takehara et al.

[11] Patent Number: 5,384,634

[45] Date of Patent: Jan. 24, 1995

[54] SHEET POST-PROCESSING APPARATUS HAVING TRAYS FOR RECEIVING SETS OF SHEETS

[75] Inventors: Yoshifumi Takehara; Kimiaki Hayakawa; Noriyoshi Ueda, all of Yokohama, Japan

[73] Assignee: Canon Kabushiki Kaisha, Tokyo, Japan

[21] Appl. No.: 284,050

[22] Filed: Aug. 1, 1994

Related U.S. Application Data

[63] Continuation of Ser. No. 852,997, Mar. 17, 1992, abandoned.

[30] Foreign Application Priority Data

Mar. 18, 1991 [JP] Japan ..... 3-052431
Mar. 18, 1991 [JP] Japan ..... 3-052432
Mar. 19, 1991 [JP] Japan ..... 3-080818

[51] Int. Cl.[6] ..... G03G 15/00; B65H 31/00; B65H 39/11

[52] U.S. Cl. ..... 355/323; 355/324; 270/53

[58] Field of Search ..... 355/321, 322, 323, 324; 270/53, 58; 271/293, 294

[56] References Cited

U.S. PATENT DOCUMENTS 4,376,529 3/1983 George et al. ..... 270/53
4,444,491 4/1984 Rinehart et al. ..... 355/323 X
4,688,924 8/1987 Anzai et al. ..... 355/323
4,746,111 5/1988 Naramore ..... 270/58 X
5,011,130 4/1991 Naito et al. ..... 271/288
5,021,837 6/1991 Uto et al. ..... 355/322
5,035,412 7/1991 Hiroi et al. ..... 270/53
5,050,860 9/1991 Matsuo et al. ..... 271/293
5,060,922 10/1991 Shibusawa et al. ..... 270/53
5,186,445 2/1993 Nakanishi et al. ..... 270/53

FOREIGN PATENT DOCUMENTS 0355751 2/1990 European Pat. Off. .
3923025A1 2/1990 Germany .
58-17063 2/1983 Japan .
60-223764 11/1985 Japan .
62-20046[U] 2/1987 Japan .
1516985 7/1978 United Kingdom .
2155909 10/1985 United Kingdom .
2173483 10/1986 United Kingdom .
2228256 8/1990 United Kingdom .

*Primary Examiner*—Joan H. Pendegrass
*Attorney, Agent, or Firm*—Fitzpatrick, Cella, Harper & Scinto

[57] ABSTRACT

A sheet post-processing apparatus includes at least one sheet receiving device for stacking sheets; an aligning device for aligning sheets on the sheet receiving device; and a sheet conveyer for conveying a set of aligning sheets in a direction crossing with a sheet receiving direction of the sheet receiving device.

39 Claims, 26 Drawing Sheets

SHEET POST-PROCESSING APPARATUS HAVING TRAYS FOR RECEIVING SETS OF SHEETS

This application is a continuation of application Ser. No. 07/852,997, filed Mar. 17, 1992, now abandoned.

FIELD OF THE INVENTION AND RELATED ART

The present invention relates to a sheet post-processing apparatus for processing the sheet materials discharged from an image forming apparatus after the sheet materials are sorted and received on bin trays. The image forming apparatus may be a copying machine, a laser beam printer or another printer or the like.

A sheet post-processing apparatus capable of sorting and accommodating a number of sets of sheet materials which is larger than the number of bin trays disposed at the discharging side of the image forming apparatus is known.

In such an apparatus, the sets of predetermined number of sheet materials are sequentially conveyed out by conveying means and are stacked on a stack tray of a stacker disposed downstream of the sheet post-processing apparatus with respect to the sheet conveyance direction. As a result, there is provided empty bin trays, which are now capable of accommodating the sheet materials again, and therefore, a larger number of sets of the sheet materials than the number of bin trays, can be processed.

However, in the sheet post-processing apparatus, involves the following problems because the stack tray is disposed downstream of the sheet post-processing apparatus:

(1) Both of the sheet post-processing apparatus A and the stack tray 451 have the width for permitting accommodation of usable maximum size sheet, and when they are arranged in a series along the sheet conveying direction, the entire apparatus including the copying machine or the like becomes very bulky $L_1$ (FIG. 30) thus requiring a large installing area:

(2) Since the operating panel 450 and the stacker 400 are distant from each other, the operativity is not good in consideration of the case in which after the operator manipulates the operating panel 450, the operator is going to take the sets of sheet materials from the stacker after the end of the copying operation:

(3) An even larger area $L_2$ is required (FIG. 30) when two or more sheet post-processing apparatuses A, B are arranged so that one A of them deals with the sorting operation, and the other B deals with the stapling and sheet stacking operation, alternately, by which the continuous operation is permitted without stopping the operation of the main assembly of the apparatus.

In a conventional sheet sorter 800, as shown in FIG. 31, while the bins B are moved by a bin moving means including lead cam or the like, the sheets S on the bins B are abutted to an alignment reference member 802 at the front side by the movement of a rear aligning member 801 in the direction indicated by an arrow, so that the sheet materials are aligned. After the alignment, if required, a bin binding means 803 is inserted to bind the sets of the sheet materials sorted and accommodated, respectively.

In the apparatus of FIG. 31, however, the aligning reference member 802, the lead cam 40, trunnion 30 or the like are disposed at the front side of the sorter 800, and therefore, even if the operator tries to take the sheets out of the bins, it is not possible to take them out in the direction of arrow S. Therefore, the operator has to taken them out in the direction R. If the operator tries forcedly to take out in the direction S, they must be moved in the two directions (T), and therefore, the operation is very difficult.

Referring to FIG. 30, the operator works at the position T (document feeder) in the copying machine 102, and thereafter, the operator moves to work in the direction U after the copying operation, with the result of poor operativity (FIG. 32).

SUMMARY OF THE INVENTION

Accordingly, it is a principal object of the present invention to provide a sheet post-processing apparatus and an image forming apparatus provided with the same in which the sheet sets are properly aligned with high operativity.

In an aspect of the present invention, the set of aligned sheet materials are pushed in the direction crossing with the sheet discharging direction. Therefore, the size of the sheets post-processing apparatus and the image forming apparatus can be reduced with high operativity.

According to another aspect of the present invention, there is provided an apparatus in which there are first sheet aligning means for aligning the received sheet materials at one lateral edges, and second sheet aligning means for aligning the sheets at the other lateral end. Then, the sheet materials are sandwiched by the first and second sheet aligning members on the sheet tray, and therefore, the sheet materials can be aligned at any position on the sheet receiving tray by changing the positions of the first or second aligning member with certainty and with high speed.

According to another aspect of the present invention, there is provided an apparatus having a sheet binding means or another post-processing means, so that the sheet materials can be aligned at any position on the sheet receiving tray, and they are post-processed at any position. Therefore, the sheet materials can be assuredly post-processed irrespective of the size of the sheet materials and the number of sheets to be processed.

According to a further aspect of the present invention, there is provided an apparatus wherein the sheet materials on the sheet receiving tray are conveyed to a stacker, so that the sheet materials are taken out of the sheet receiving trays, and therefore, the capacity of the sheet post-processing apparatus can be increased.

According to a further aspect of the present invention, there is provided an apparatus having a number of bins capable of accommodating the sheet materials, bin moving means, sheet conveying means for conveying the sets of sheet materials on the bins, and stacking means for stacking the conveyed sheet sets. Then, the sheet materials are conveyed out from the bin which has last received the sheet materials (sheet discharge or sheet post-processing). In this case, the sheet taking outlet is disposed faced to the processing bin of the post-processing apparatus such as stapler or the like, and therefore, when the stapling operation is completed after the sheet sorting, the sheet taking out operation can be started immediately after the stapling operation. By conveying the sheet from the bin which last processed, the efficient post-processing apparatus can be provided.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
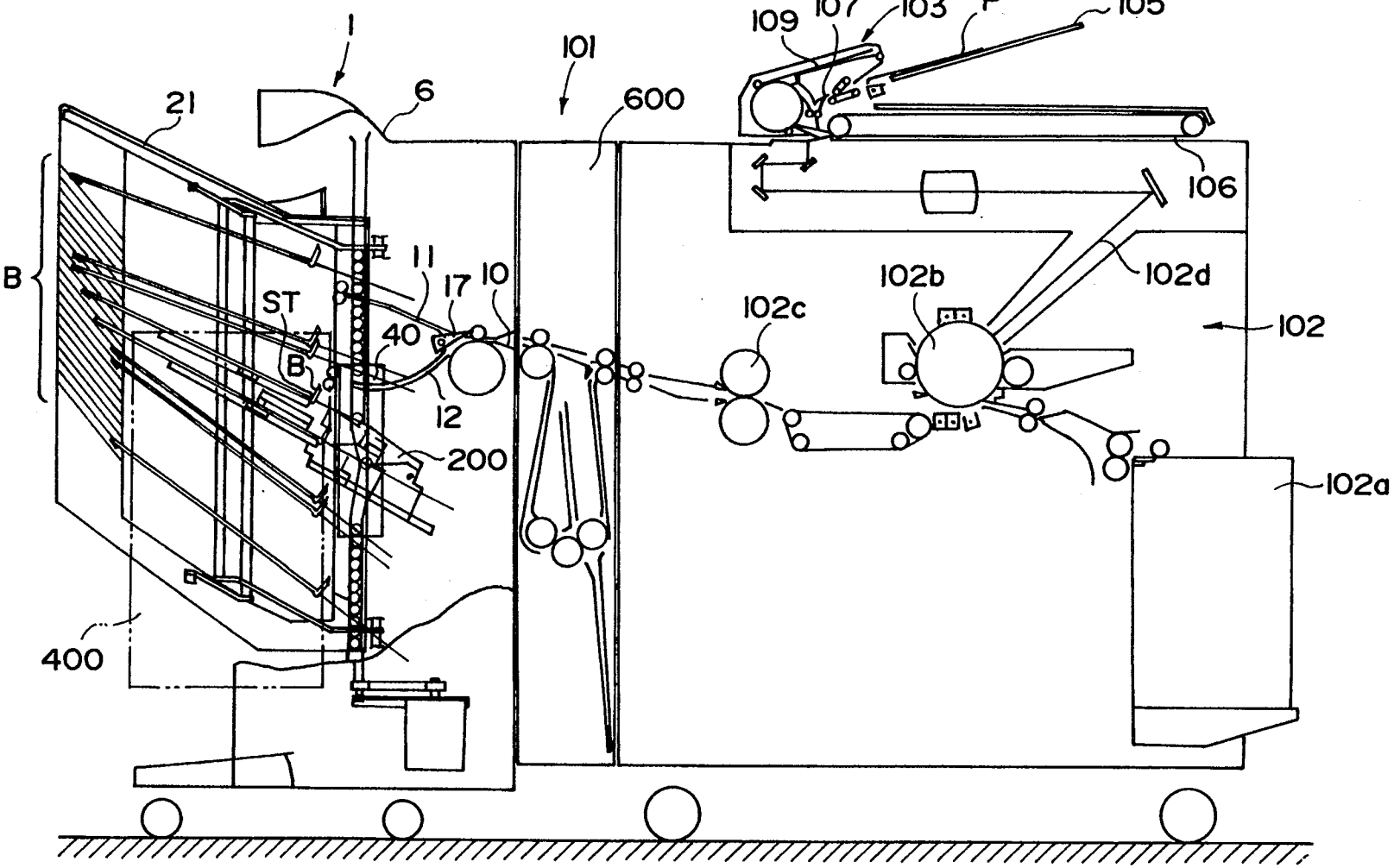
FIG. 1 is a sectional view of an image forming unit, according to an embodiment of the present invention.

Referring to now FIG. 1, the image forming unit 101 comprises a copying machine 102, deck 102*a*, photosensitive member 102*b*, image fixing device 102*c*, an image reader 102*d*, an automatic document feeder 103 on the copying machine 102, a sheet folder 600 disposed at one side of the copying machine 102, a sorter 1 downstream thereof, and a stacker 400 for stacking the sheets sorted in the sorter 1.

The original P on the original stacker 105 of the automatic document feeder 103 is separated from the bottom of the set of the originals P, and the separated original is fed along the passage 107 onto the platen glass 106 of the copying machine 102. The original is then read by the optical system of the copying machine 102. After it is read, is discharged onto the top of the stack of the originals on the original stacker 105, along the passage 109 from the platen glass 106.

Figure 2:
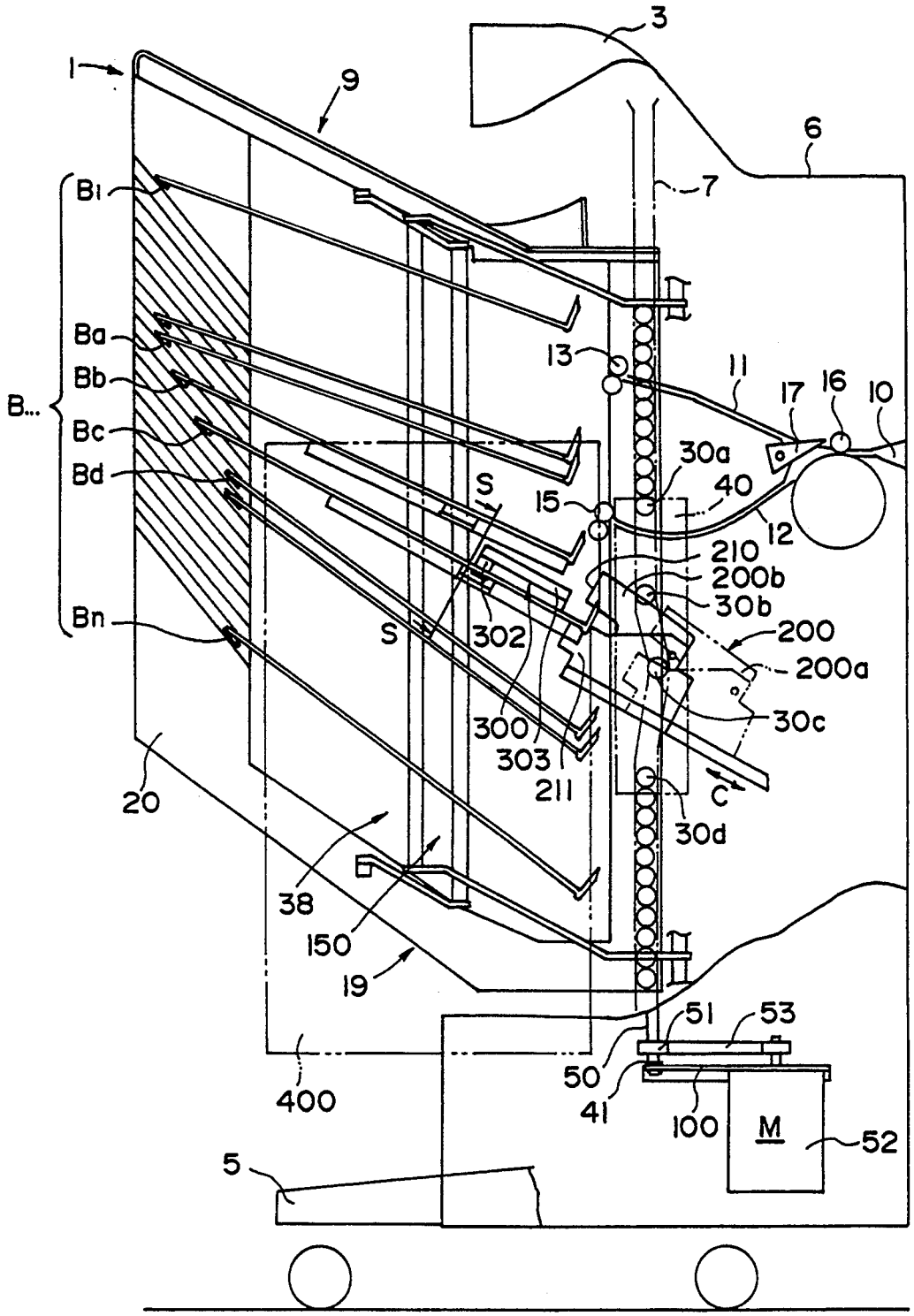
FIG. 2 is a side view of a sorter.
Figure 3:
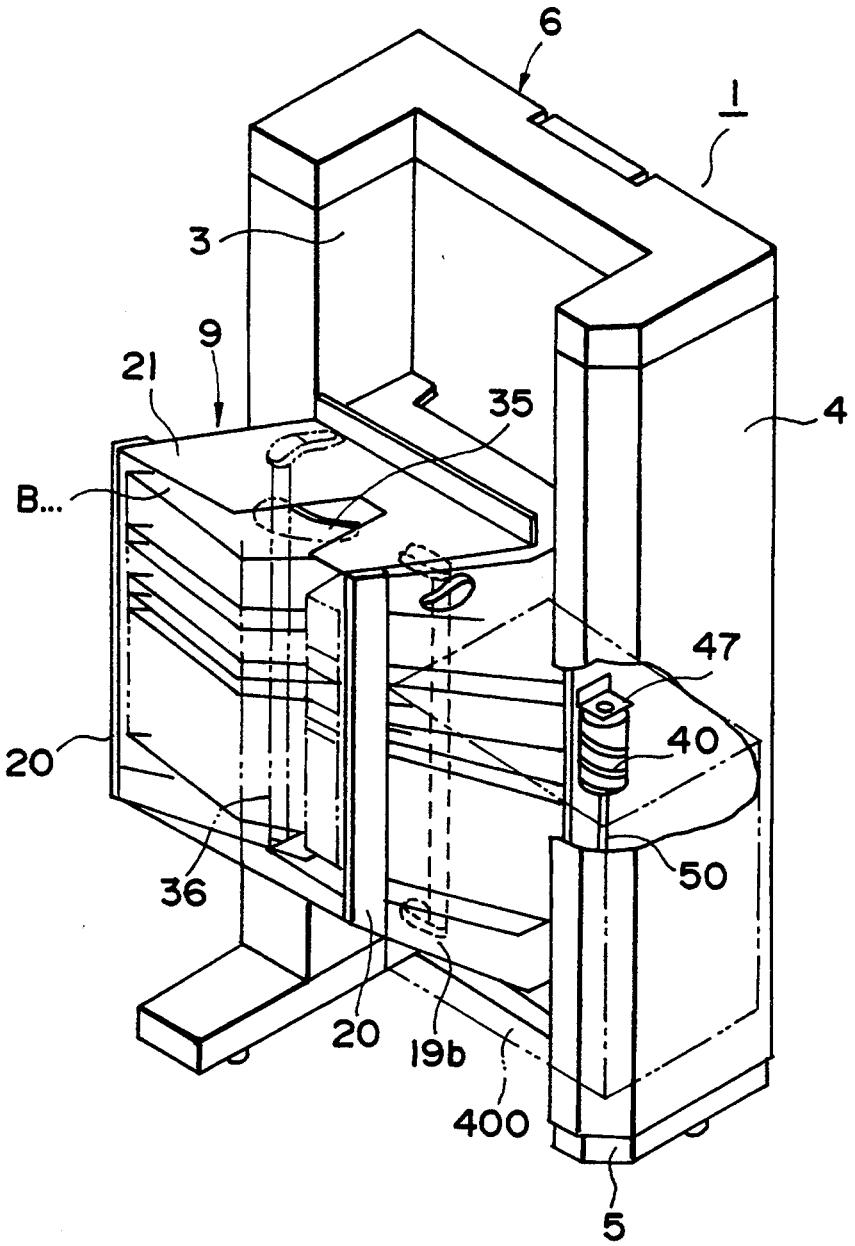
FIG. 3 is a perspective view of a sorter.

As shown in FIGS. 2 and 3, the sorter 1 comprises a sorter main assembly 6 including a pair of front and rear plates 3, a base member 5 and a cover 4. Also it comprises a bin unit 9 which includes a number of bins B and which is substantially vertically movable along guide rails 7 on the sorter main assembly 6.

The sorter main assembly 6 is provided with a sheet inlet 10 for receiving the sheets S discharged from the image forming apparatus such as the copying machine 102. A first sheet conveyance passage 11 is extended from the sheet inlet 10 to the bin unit 9. Branching out of the first conveyance passage 11, a second sheet conveyance passage 12 is formed. Downstream of the first sheet conveyance passage 11, there are a pair of upper discharging rollers 13 for discharging the sheets non-sorted. Downstream of the second sheet conveyance passage 12, there are a pair of lower discharging rollers 15 for discharging the sorted sheets to be sorted.

At the branch for the first and second sheet conveyance passages 11 and 12, there are a pair of sheet receiving rollers 16 and a deflector 17. When the non-sorting mode is selected, the deflector 17 deflects the sheets S to the first sheet conveyance passage 11, and when the sorting mode is selected, it deflects the sheets S to the second sheet passage 12.

Figure 4:
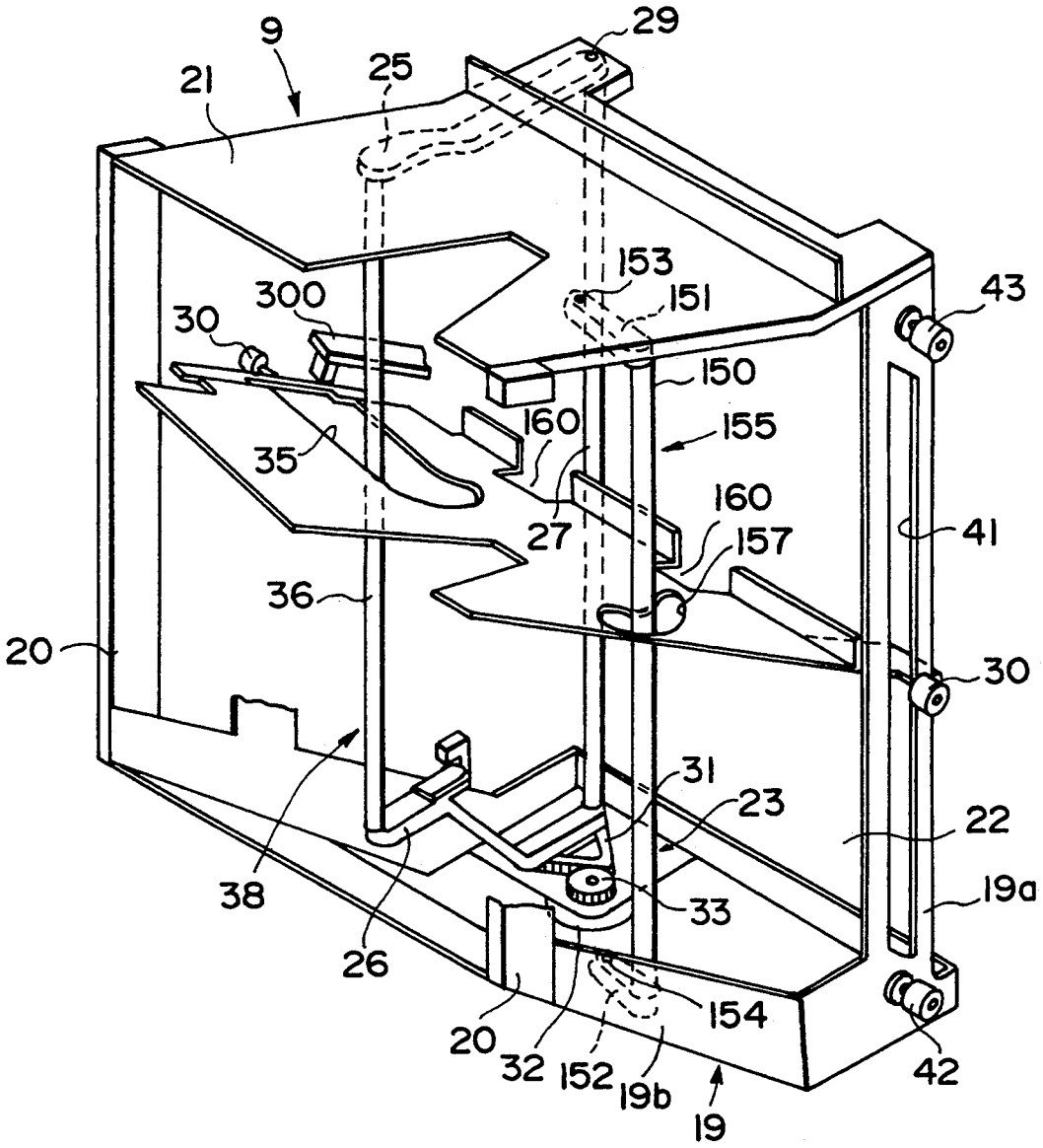
FIG. 4 is a perspective view of a bin unit.

As shown in FIG. 4, the bin unit 9 comprises a bin frame 19 including a standing portion 19*a* and a bottom portion 19*b* at the front and rear sides. A bin slider 20 is mounted to an end of the bottom portion 19*b* of the bin frame 19, and the standing portion 19*a* of the bin frame 19 and the bin slider 20 are fixed to a bin cover 21 at the respective end portions.

At the rear side of the base portion of the bin frame 19, a supporting plate 23 is fixed. Rotational shaft 27 is rotatably mounted on the supporting plate 23 by a pin on the supporting plate 23 and a pin 29 on the bin cover 21. The shaft 27 is provided with a top arm 25 fixed thereto at the top and a bottom arm 26 fixed thereto at the bottom. Between the top arm 25 and the bottom arm 26, there is a first aligning member 38 having an aligning rod 36. To the supporting plate 23, a sector gear 31 is rotatably mounted about a pin on the supporting plate 23. The sector gear 31 is provided with a bottom arm 26 fixed thereto. Below the supporting plate 23, there is disposed a pulse motor 32 having an output shaft to which a gear 33 is fixed. The gear 33 is meshed with the sector gear 31. The aligning rod 36 mounted to the end portions of the top and bottom arms 25 and 26, penetrates through apertures 35 formed in the respective bins to permit swinging movement of the aligning rod 36 by the rotation of the sector gear 31.

At the front side of the bin frame, a second aligning member 155 comprising a top arm 151, a bottom arm 152 and an aligning rod 150 is provided. A rotational pin 153 is mounted on the bin cover 21 for the support for the top arm 151, and a rotational pin 154 is mounted on the bin frame 19 for the rotation of the bottom arm 152, so that they are rotated by driving means $32_3$ about the rotational pins.

Similarly to the aligning rod 36, the aligning rod 150 is penetrated through all the bins having the apertures 157.

Figure 6:
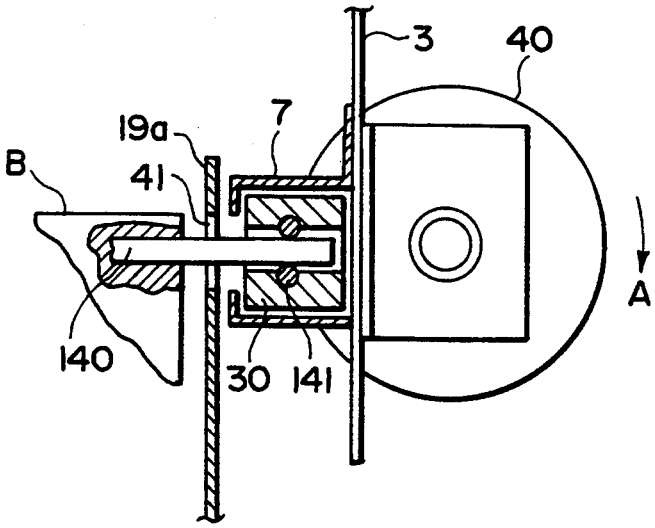
FIG. 6 is a top plan view illustrating the engagement between the lead cam and a trunnion.

An ends of the bins B accommodated in the bin unit 9 are movably supported in comb-like channels of the bin slider 20 (FIG. 2). The base end portions thereof are rotatably supported on the respective pins 140 fixed on the trunnions 30, as shown in FIG. 6. The pin 140 penetrates through a slit 41 formed in each of front and rear pin supporting plates 19*a*, and to the pin 140, the trunnion 30 is mounted through a buffering O ring 141. Such trunnions 30 are stacked in the guide rail 7, as shown in FIG. 2. The bottommost trunnion 30 is contacted, as shown in FIG. 4, to the lower guiding roller 42 rotatably supported in the standing portion 19*a* of the bin frame 19 (not shown at the rear side). The topmost trunnion 30 is contacted to an upper guiding roller 43 rotatably supported in the standing portion 19*a* of the bin frame 19, so that the bins B are supported in the bin unit 9 with the intervals between adjacent ones being equal to a diameter of the trunnion 30. The upper guiding roller 43 and the guiding roller 42 of the bin unit 9 is supported in the guide rail 7, so that it is movable substantially vertically along the guide rail 7.

Figure 9:
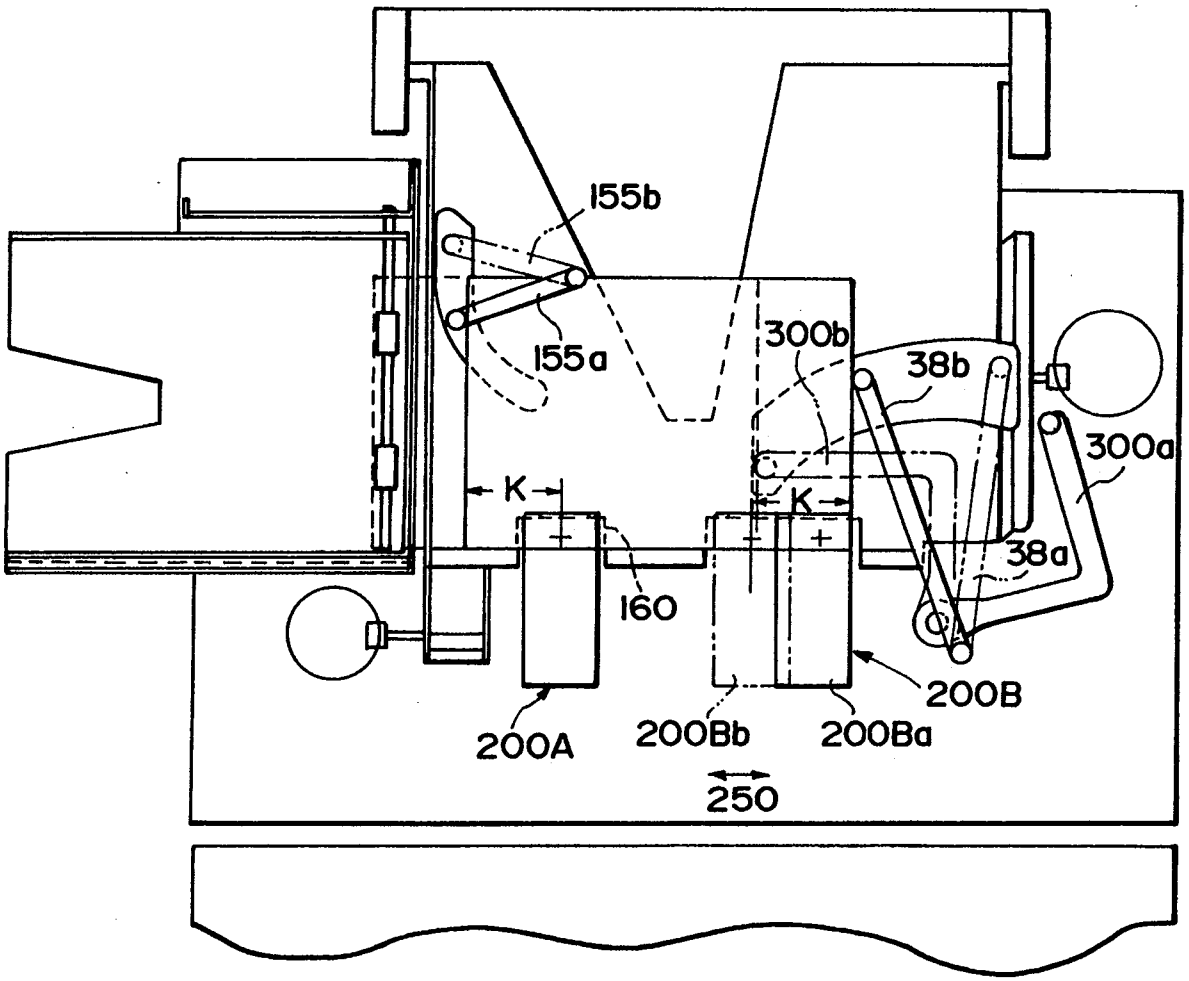
FIG. 9 is a top plan view of an apparatus in operation, according to an embodiment of the present invention.

Adjacent the lower discharging roller pair 15, there is a stapler 200 operable by electric power is disposed to bind the sheets accommodated in the bins B. The stapler 200, as shown in FIG. 2, is movable in the direction indicated by an arrow C by an unshown driving means. Normally, it is at a retracted position 200*a* not interfering the bin B moving vertically. When it binds or staples the sheets S in the bin B, it is moved to the operative position 200*b* to bind the sheets S. After the binding operation, the stapler 200 is returned to the retracted position 200*a* by the unshown driving means. Two of such staplers 200 are disposed, as shown in FIG. 9, extending vertically to the sheet movement direction (200A and 200B).

The stapler 200 is operated by rotation of an unshown motor. When the sets of sheets S in plural bins B, the sheets in one bin B are stapled, and after stapling completion signal is detected, the bin unit 9 moves through a distance corresponding one bin, and the sheets in the next bin B are stapled.

The bin B is provided with a partial cut-away portion 160 to permit entrance of the stapler, so as to avoid the interference therebetween when the stapler operates.

Since the electric power staplers 200 are provided at the two positions, one or two of the staplers 200A and 200B can be selectively operated by the operator.

As shown in FIGS. 2 and 3, cam shaft holders 47 are mounted to the front and rear side plates, respectively, at positions faced to the stapler 200 and the lower discharging roller pair 15. Between the cam shaft holder 47 and a motor supporting table 100, the lead cam shaft 50 is rotatably supported by bearings 49 against a thrust load. Above the lead cam shaft 50, lead cam shafts 40 having the helical cam surfaces are fixedly mounted, respectively. To the bottom portion, pulleys 51 are fixed. Between the pulleys 51 and the shift motor 52, a belt 63 is stretched, so that the lead cams 40 are rotated in the forward and backward direction by a reversible shift motor 52.

Figure 5:
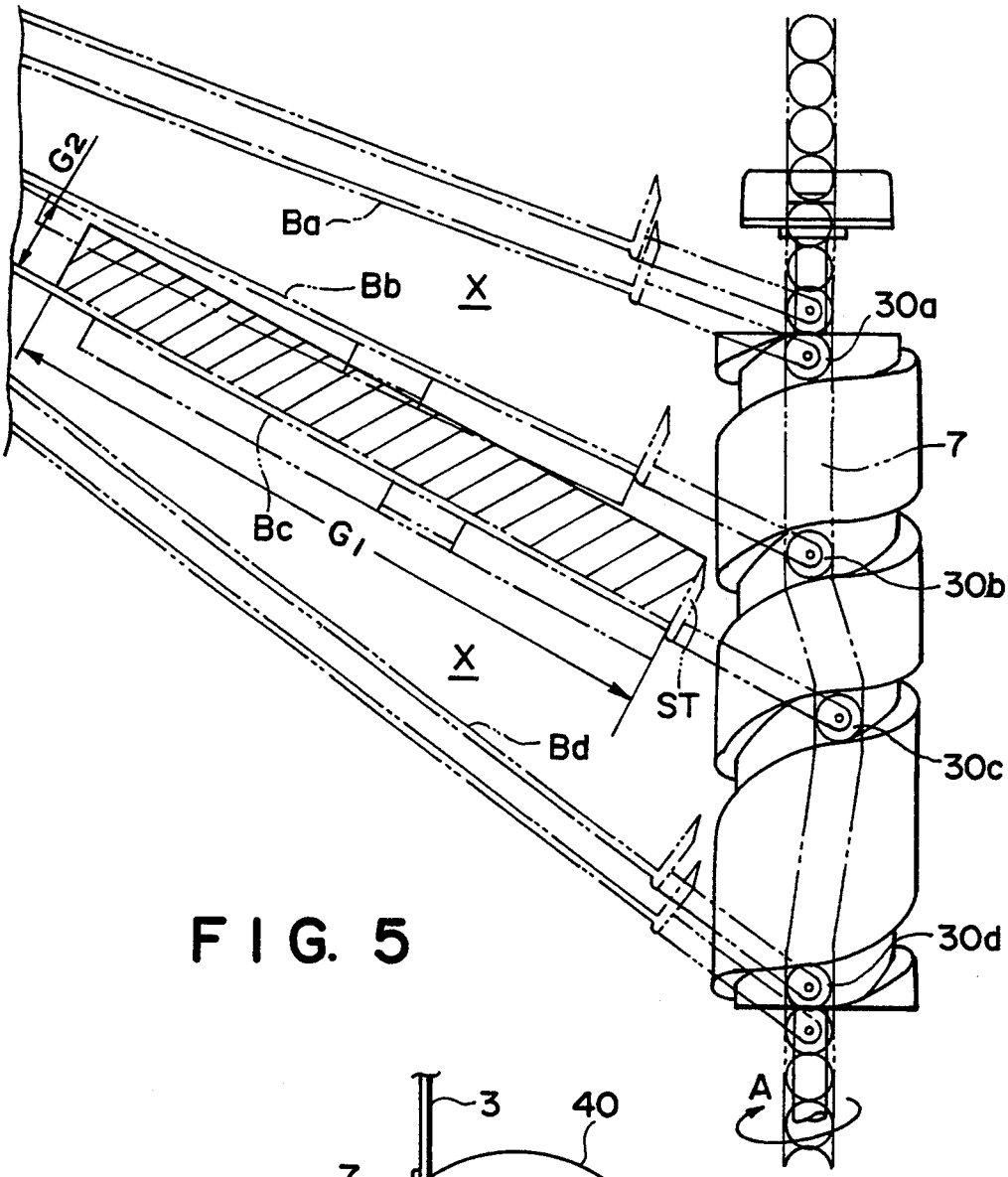
FIG. 5 illustrates movement of a bin by lead cams.

Each of the lead cams 40 is disposed faced to the lower discharging roller pair 15 disposed substantially at the center of the sorter main assembly 6 so as to move the trunnions 30 of the bins B moving toward the position faced to the lower discharging roller pair 15 in the vertical direction along the guide rails 7 having respective bent portions on the helical cam surfaces (FIGS. 2 and 5). For example, as shown in FIG. 5, by one rotation of the lead cam 40 in the direction A, the trunnion 30*d* is moved to the position indicated by 30*c* in the lead cam 40. By one more rotation, it is moved to the position 30*b*. By a further one rotation, it is moved to the position 30*a*.

In this manner, three expanded clearances X larger than the clearances between other adjacent bins, are formed between the bin Bb receiving the sheet from the lower discharging roller pair 15 and the bin Bc having the sheets S to be stapled by the stapler 200, between the bin Bb and the upper bin Ba and between the bin Bb and the lower bin Bd.

Figure 7:
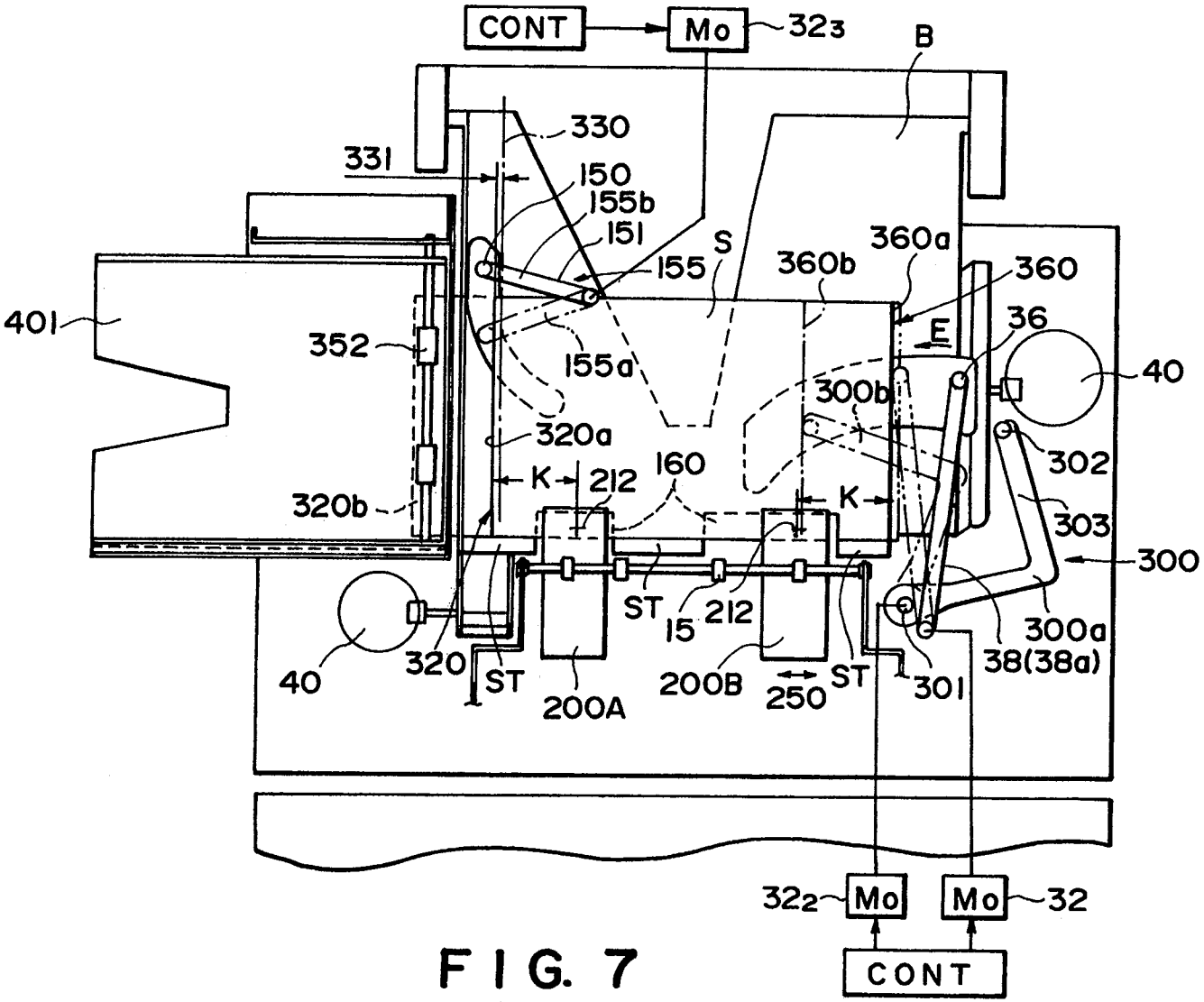
FIG. 7 is a top plan view of a bin unit in the apparatus according to an embodiment of the present invention.
Figure 8:
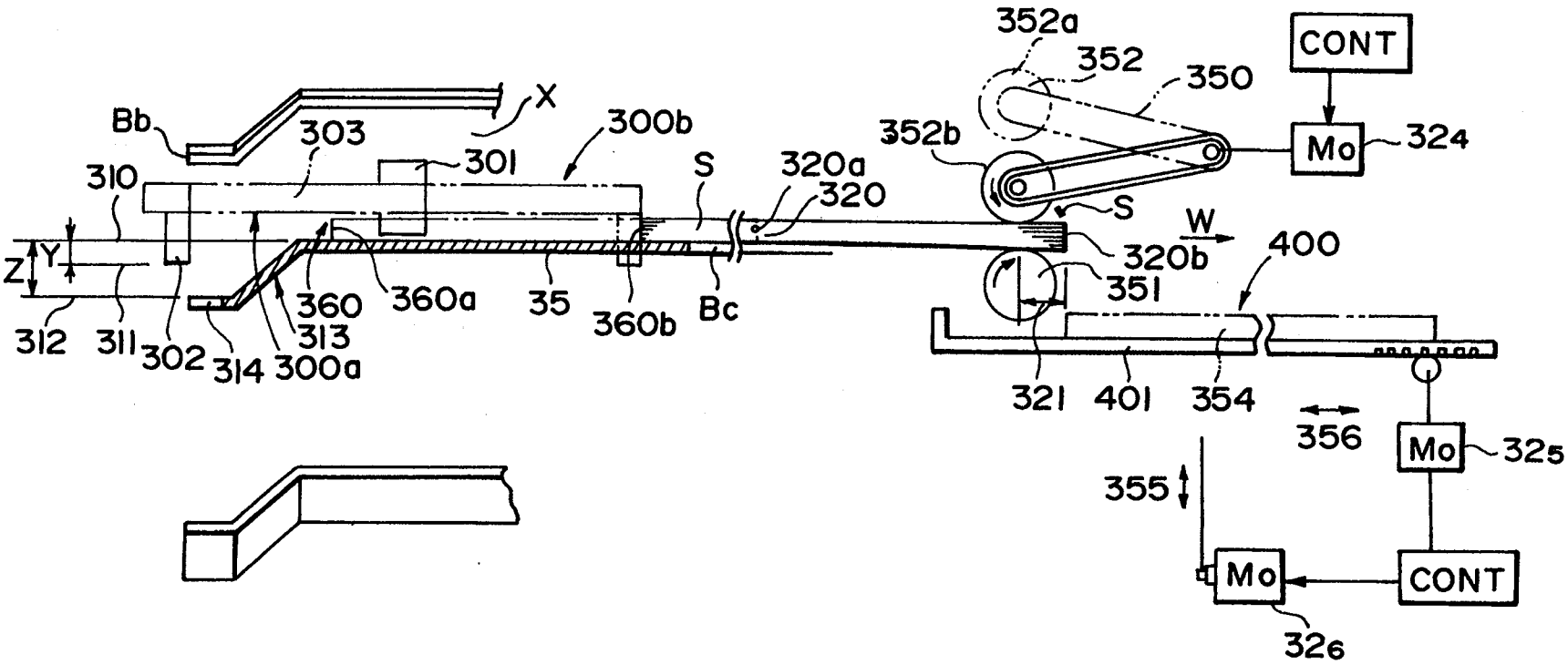
FIG. 8 is a sectional view taken along a line S—S in FIG. 2.

Referring to FIGS. 7 and 8, the sheet set taking out means will be described. The sorter main assembly is provided at the rear side of the sorter with a sheet taking out means 300 which pushes the sheets S on the bin trays. The sheet taking out means 300 comprises a pushing rod 302 and an arm 303, which are rotatable by driving means including a gear train by a motor $32_2$ about a rotational shaft 301.

The sheet taking out means 300 is provided in the main assembly at a position faced to the bin Bc having the sheets to be stapled, and therefore, even if the bin unit 9 moves vertically, it is always faced to the bin Bc. The sheet taking out means 300 is normally at the position indicated by the solid lines (300B), and is maintained at a position not interfering the vertically moving bin unit 9.

When the sheets are to be taken out, the sheet taking out means 300 rotates from the normal position to the pushing position (chain lines) corresponding to the size of the sheet materials.

As described hereinbefore, the sheet taking out member 300 is disposed faced to the bin Bc at the stapling position, and therefore, the arm 303 rotates into the expanded clearance X larger than the other adjacent bins without interference with the upper or lower bins Bb and Bc to the position indicated by chain lines (300*b*). The bottom end 311 of the pushing rod 302, as shown in FIG. 8, is a distance Y below the top surface of the bin Bc (the bottom surface of the sheets S). It is guided to the cut-away portion 35 of the bin through the operation described hereinbefore, and it pushes the sheets S with the distance Y maintained. At the rear side where the pushing rod operations for the bin Bc, there is a step 313 with a distance Z (the surface 310 carrying the sheet S and the surface 312 below it). The portion of the bin B for accepting the pushing rod forms a closed aperture connected at the portion 314 without being cut away into a U-form at the peripheral of the bin, and therefore, the strength of the bin itself can be maintained.

In this manner, the front side edges 320 of the sheets on the bin Bc are moved to the position 320*a* to the position 320*b* by the sheet taking out means 300. At the position where the sheet S is pushed, there is a stacker 400 having a tray 401, so that the edges 320 of the sheets are overlapped by a distance indicated by 321 over the center of the roller pair. They are conveyed by gripping rollers 350, and are stacked on the tray 401 of the stacker 400. The tray 401 is substantially vertically movable (direction 355) depending on the amount of the sheets stacked thereon.

As shown in FIG. 7, the lead cams 40 are disposed outside a hatched region in the sheet taking out direction (FIG. 5, the region defined by the stackable sheet width G1 and the stackable height G2), and therefore, the sheets can be taking out without difficulty along the sheet stopper ST.

The pulse motors 32, $32_2$ and $32_3$, stapler motor or the like, are controlled by control circuits in accordance with sheet size information, the sheet feeding reference instructing information (center reference or side reference), stapling position selecting information or the like.

Since the apparatus of this embodiment has the structure described above, the sheets S discharged from the image forming apparatus such as the copying machine or the like are controlled by the deflector 17 from the inlet 10, depending on the mode (non-sorting mode or the sorting mode), and are introduced into the first or second sheet conveyance passage 11 or 12.

When the non-sorting mode is selected, the sheet is fed along the first conveyance passage 11, and is discharged to and accommodated by the bin cover 21 (first bin) of the bin unit 9 by the upper discharging rollers 13.

When the sorting mode is selected, the bin unit 9 is sequentially moved by the helical cams of the lead cams 40 through the trunnions 30 by the rotation of the lead cams 40, so that the three expanded clearances are provided at a position faced by the lower discharging roller pair 15, and the bin faced to the stapler 200, and in addition, the upper guiding roller 43 or the lower guiding roller 42 is pushed by the moving trunnion 30. The sheet S is moved along the second sheet conveyance passage 12 by the lower discharging rollers 15, and is discharged to and accommodated by the opened bin in the order from the first bin to the subsequent bins.

When, for example, the sheet S is discharged to the bin Bb faced to the lower discharging roller pair 15, it moves by its weight to the rear end stopper ST, since the bin Bb is inclined in that direction.

Before the start of the sheet stacking on the bin Bb, the second aligning member 155 is moved from the retracted position 155*b* to the reference position 155*a* functioning as the sheet end reference position, by driving means including a motor $32_3$ and the gear train operably coupled therewith. The aligning rod 36 of the first aligning member 38 is moved through a predetermined amount in the direction E from the retracted position 38*a* by a pulse motor 32 operating in accordance with the pulse signals corresponding to the sheet size. The pulse signals are supplied from the control circuit responsive to the size selection button or the cassette size directing means or the like. By doing so, the edge of the sheet S is abutted to the aligning rod 150 of the second aligning member 155. After the first aligning member 38 moves through a predetermined distance, it returns to the retracted position preparing for the next sheet discharge. At this time, the sheet S is discharged onto the bin B of the sorter 1 from the main assembly of the copying machine 102 along a reference line 330 at the front side (the discharging position of the sheet front end is constant). It is shifted by a distance 331 by the first aligning member 38, so that it is aligned with the other sheets on the bin. Alternatively, the sheets may be aligned by moving the first aligning member in accordance with the reception of the sheet by the bin B from the retracted position to the aligning position with the second aligning member as the reference position. Further alternatively, both of the aligning members may be moved to the respective aligning positions. By repetition of the above operations, the sheets S are aligned on one bin Bb with the lateral edges aligned to the second aligning member 155, and the rear edges aligned with the rear stopper ST.

The aligning rod 36 of the first aligning member 38 penetrates through all the bins, so that the sheets S received by the other bins are similarly aligned.

The sheets S accommodated in the bins B are selectively stapled. When the stapling mode is not selected, the operation of the sorter 1 temporarily stops here.

When the stapling mode is selected, the stapler 200 is shifted to the stapling position 200*b* (solid lines) from the retracted position 200 in response to the stapling start signal produced by the control means not shown (FIG. 2).

As shown in FIG. 2, for example, the head portion 210 of the stapler 200 enters the upper expanded portion X between the bin Bc carrying the sheets to be stapled and the upper bin Bb, and an anvil portion 211 thereof enters the lower expanded portion X, and by the moving means such as rack and pinion mechanism they are moved to the stapling position.

When the stapler reaches the stapling position, the stapling permitting signal is produced from an unshown control means, and the stapler 200 is driven, so that the sheets S are stapled with staple 212.

When the sheets are stapled, the stapler 200 is returned to the retracted position 200*a*, so that the stapling operation for one bin is completed.

In the stapling operation for plural bins, it is most efficient if the stapling operation starts with the last sheet received bin B. At this time, in response to the bin shift completion signal, the series of operations of the stapler 200 is carried out. In response to the signal indicative of the completion of the series of the stapler 200 operation, the next bin shift operation is started. By repeating this operation, the stapling operation is automatically carried out to its completion.

In this embodiment, the second aligning member 155 is provided in the bin frame 19 of the bin unit 9, and the bin unit 9 is provided with the first aligning member 38 comprising the aligning rod 36 or the like for aligning the sheets, so that the sheets S in the bin B can be assuredly aligned. Since the sheets are aligned by the aligning rod penetrating through all the bins, and since the aligning rod 36 is mounted on the bin unit 9, the sheets are aligned by the aligning rod not only after the sheets are discharged onto the bins B but during the movement of the bin shift. In other words, the sheets S, except for the sheet being discharged to the bin B, can be aligned.

In this embodiment, the movements of the first and second aligning members 38 and 155 are carried out as rotation about a rotational shaft, and since the rotational shafts are integral with the bin unit 9, the aligning operations are always stabilized.

Since the two expanded clearances X and X' are simultaneously formed at the position corresponding to the stapler 200, both of the head portions 210 and the anvil portions 211 of the stapler 200 can be moved to the stapling positions without difficulty when the stapler 200 is to bind the sheets, and in addition, the sheet can be stapled without interference to the sheets S accommodated in the lower bin.

In the foregoing description, the sheet aligning means is explained when the sheets are discharged with its front side lateral end is aligned with a reference position (left side in FIG. 7), the reference position may of course be at the rear side.

Figure 13:
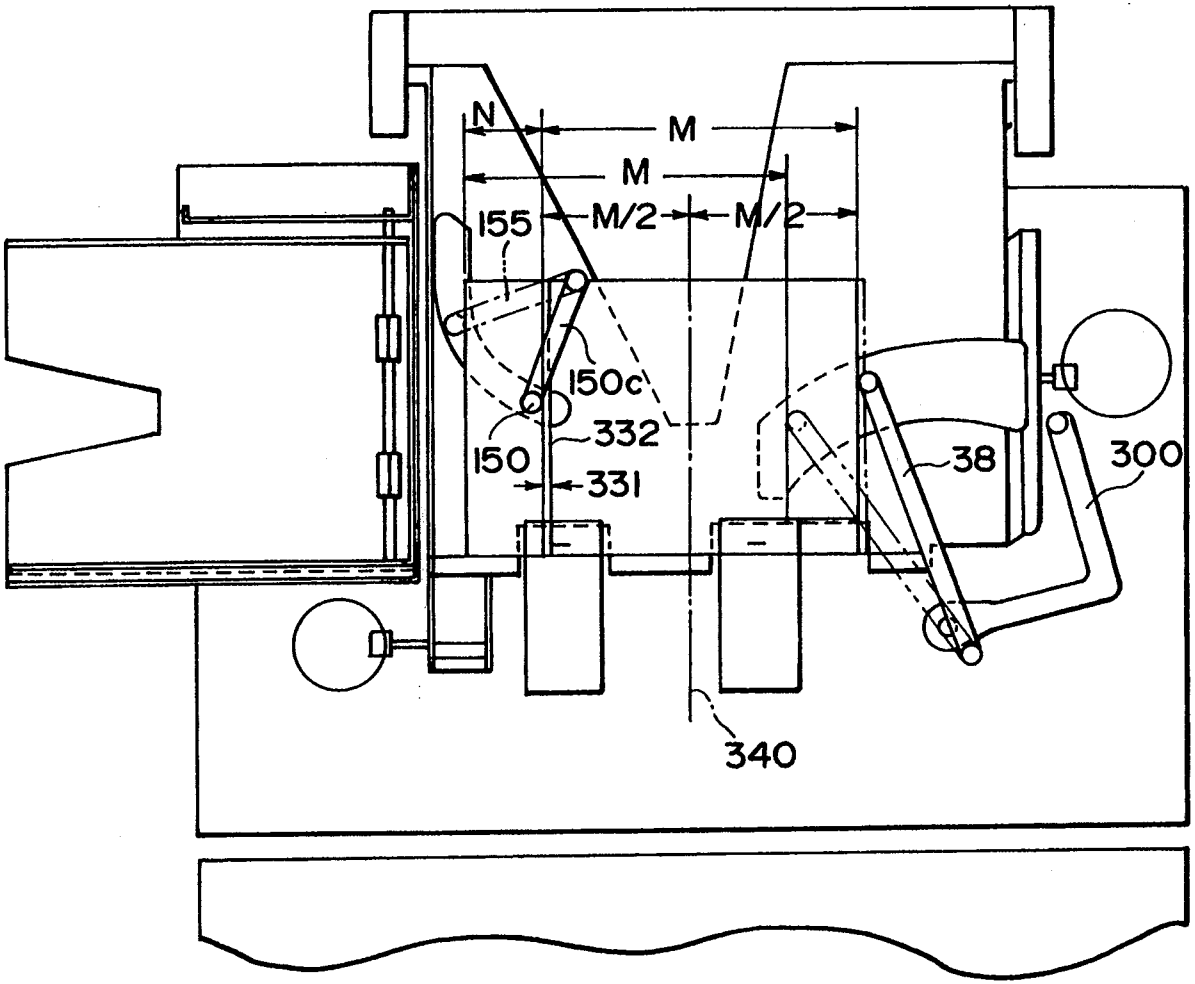
FIG. 13 is a top plan view of an apparatus in operation, according to an embodiment of the present invention.

The description will be made as to the case in which the sheet is discharged to the bin with its center 340 is aligned on the bin. When the sheet width is large, and therefore, the movement distance of the first aligning member 38 is not large, the above-described aligning method is practical. However, when the sheet has a small width M, the movement distance N of the aligning member for the sheet S is large (FIG. 3). If the sheet interval is short, the aligning rod may interfere the next sheet if the first aligning member 39 is operated at sufficiently high speed. In view of this, as shown in FIG. 13, the second aligning member 150 is shifted to the position indicated by 150*c*, and the first aligning member 38 is moved in the same manner as described hereinbefore. By doing so, the movement distance of the first aligning member 38 is small. Therefore, such small width sheets can be aligned without difficulty. In this case, the sheet discharging position 332 (front side of the sheet) is away from the aligning rod by a distance 331 so as to avoid the interference therebetween. In this case, the aligning member 38 may be fixed at the reference position, and the second aligning member 150 may be moved. In addition, both of the aligning members 38 and 150 may be moved to the respective reference positions. This structure is applicable to a one lateral side reference sheet feeding or to the center line reference sheet feeding.

When the aligning operation or the stapling operation if the operator selects it, the control means produces a sheet taking out signal, and the sheet taking out operation is started. First, the bin from which the sheets are to be taken out, is moved to the position BC faced to the sheet taking out means or pushing member 300, and the second aligning member is rotated from the alignment reference position 155*a* to the retracted position 155*b* not interfering the sheet S being taking out.

The sheet taking out means 300 rotates from the retracted position 300*a* to a predetermined pushing position 300*b* in accordance with the size of the sheet. By doing so, the pushing rod of the sheet taking out means 300, as described hereinbefore, is moved from the initial alignment position 360*a* at the rear side 360 of the sheet S to the taking out position 360*b* (FIGS. 7 and 8). Since the sheet S moves along the rear end stopper ST at the rear edge thereof at this time, the sheets are not deviated on the bin B. After the movement of the sheets through a predetermined distance, the sheet taking out means 300 is returned to the initial retracted position 300*a*. Through the operation described hereinbefore, the leading edges 320 of the sheets S are moved from the position 320*a* to the position 320*b*. At the position corresponding to the leading edges 320*b* of the sheets S after the movement, a pair of gripping rollers 351 and 352 are disposed. The upper roller 352 is at the upper retracted position 352*a*. When a detecting means S detects the entrance of the leading edges of the sheets, it lowers to the gripping position 352*b* by driving means to become cooperative with the lower roller 351 to grip the sheets by urging means. Thereafter, the rollers 352 and 351 rotate in the direction indicated by an arrow to move the sheets S in the direction W to the tray 401 of the stacker 400 (sheets S are indicated by reference 354). The tray 401 is rotatable in the direction indicated by an arrow 355 in accordance with the stacking state. The sheets are sorted for respective bins, it is shiftable in a direction indicated by an arrow 365 by a rack and pinion mechanism.

Through the above operations, the sheet taking out operation is completed for one bin. In the sheet taking out operations for plural bins, and when the sheets are not bound, the sheet taking out operations start for the bin on which the sheet are lastly discharged and accommodated. When the sheets are stapled, the sheet taking out operations start from the bin on which the sheets are last stapled. By doing so, the efficient operations are accomplished. At this time, the series of sheet taking out means 300 operation and the stacker 400 operation, are carried out in accordance with the bin shift completion signal. Further, in response to the completion signal for the series of operations, the next bin shift operation is started. By repeating the operation, the sheet taking out operation and the stacking operation on the stacker, are automatically completed. Here, the bin shift operation may be performed during the sheet taking out operation.

When the bin moves substantially vertically, at least one of the first aligning member 38 and the second aligning member 155 is at the sheet aligning position. After the shifting operation, the movable side aligning rod is operated to realign the sheets, by which the non-stapled sheets are not deviated on the bin.

The description will be made as to the stapling positions in the stapling mode. The description will be made in the case of one side reference sheet feeding.

(i) Two Position Stapling

As described hereinbefore, two staplers 200 are provided at two different positions. The rear side stapler 200B is movable in the direction indicated by an arrow 250 by a driving means including a rack and pinion mechanism and a motor. In the case of a large size sheet used, as shown in FIG. 7, the distance from the sheet end of the staple position 212 is K, at the stapling position. As shown in FIG. 9, in the case of small size sheet, the rear side stapler 200B is shifted to the position indicated by 200Bb, by which the distance K between the staple position and the sheet edge may be maintained constant irrespective of the size of the sheet. With this structure, the sheet may be stapled at the two different positions. The distance between the sheet edge and the staple position can be changed if the cut-away portion 160 of the bin B is made larger in the direction of the arrow 250 and if the stapler 200A is made movable in the direction of an arrow 250.

Figure 12:
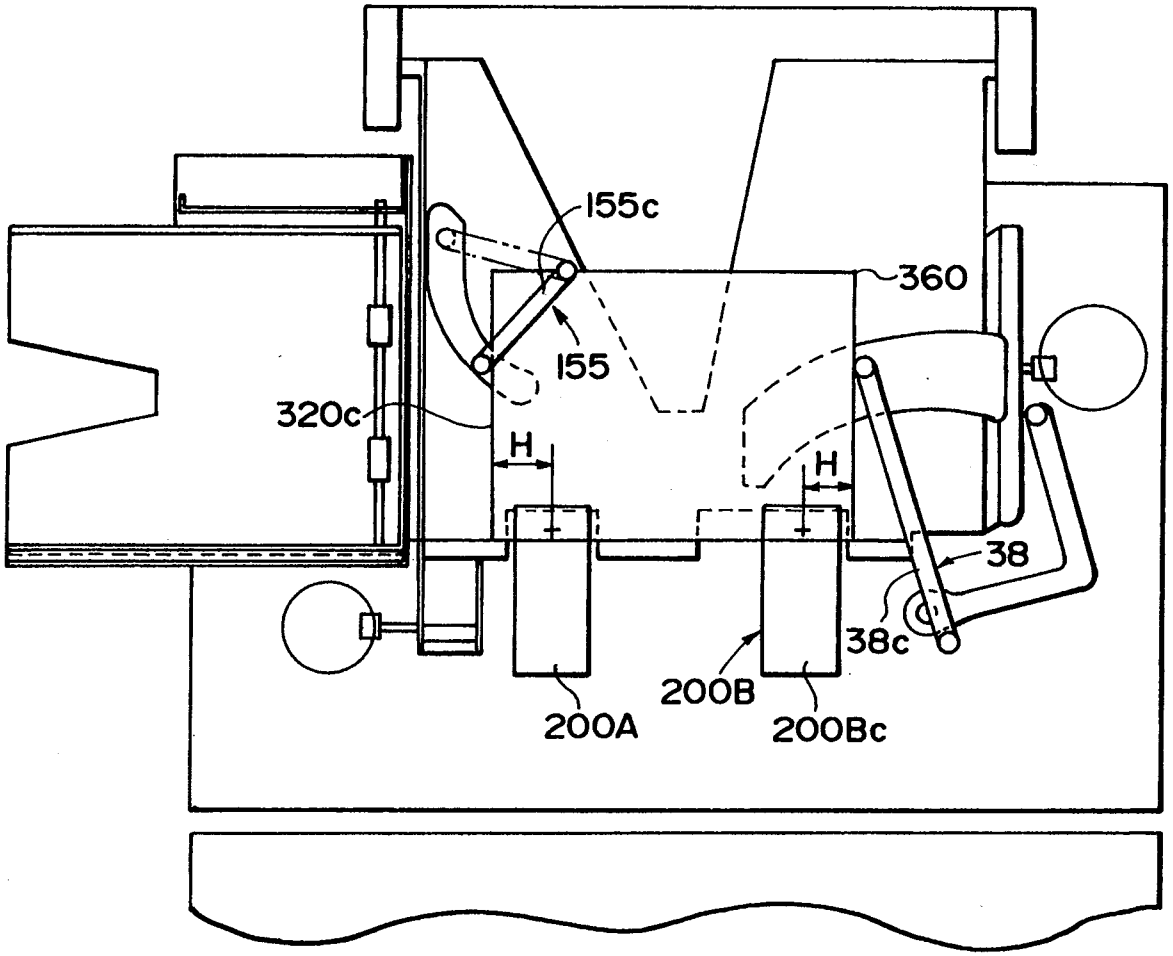
FIG. 12 is a top plan view of an apparatus in operation, according to an embodiment of the present invention.

The description will be made as to the structure in which the distance between the sheet edge and the staple position K is changed in FIG. 9. As shown in FIG. 12, the second aligning means 155 is moved toward the rear side (155*c*) from the position 155*b* in FIG. 9. By doing so, the front side edge 320 of the sheet S is shifted to the rear side 320*c*. Thus, the position of the staple from the sheet edge changes from K to H. At this time, the first aligning means 38 aligns the rear side edges 360 of the sheets at 38*c*. As described hereinbefore, both of the first and second aligning members may be used as the reference, or both may be used for the alignment. By moving the rear side stapler 200B to the position 200Bc H away from the sheet rear edge, it is possible to staple the sheets at the rear side with the distance H. With the above structure, the sheets may be stapled at the two positions in accordance with the sheet size and with the variable stapling positions. A larger latitude for the stapling position is provided if the size of the cut-away portion of the bin B is slightly increased and if the electric power stapler 200A is made movable in the direction of the arrow 250.

(ii) One Position Stapling

Figure 10:
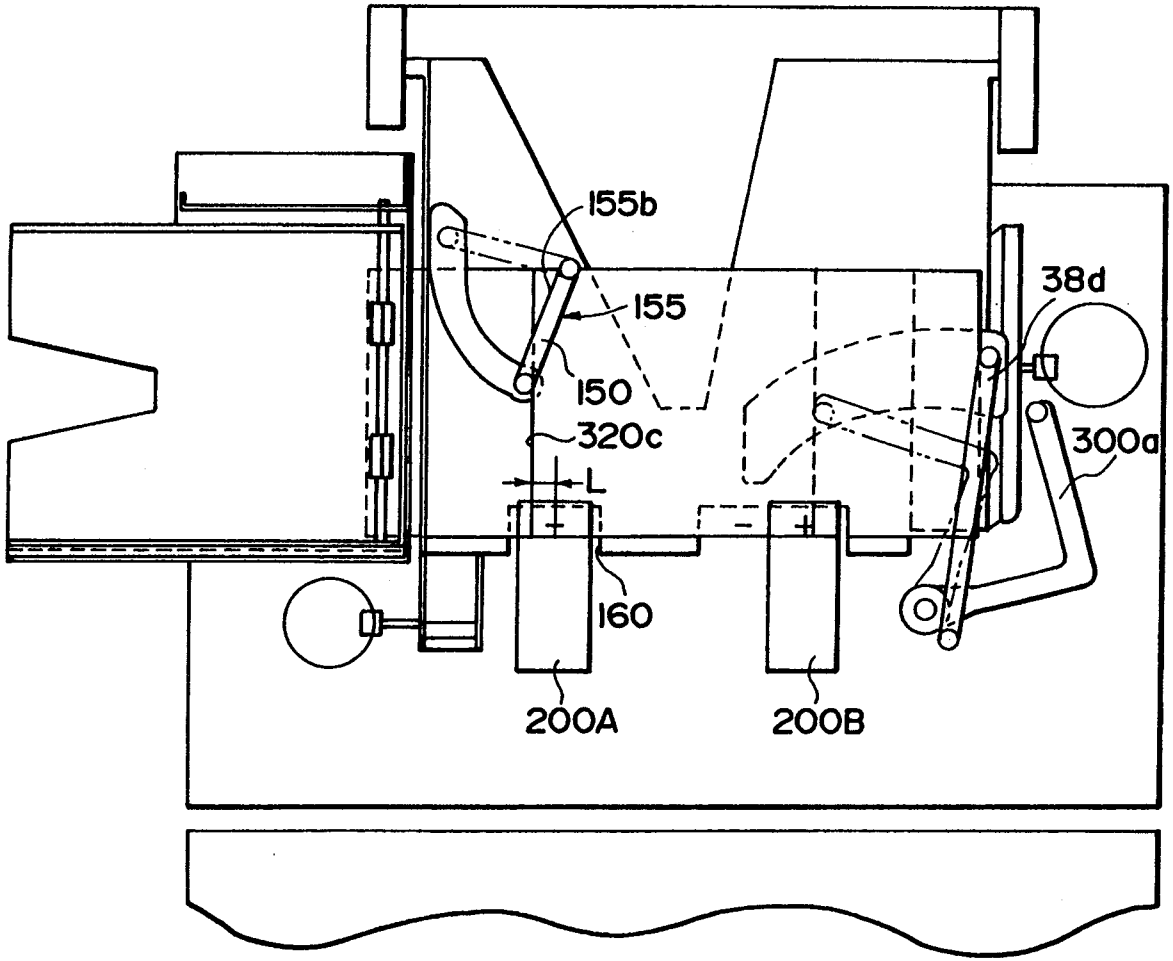
FIG. 10 is a top plan view of an apparatus in operation, according to an embodiment of the present invention.
Figure 11:
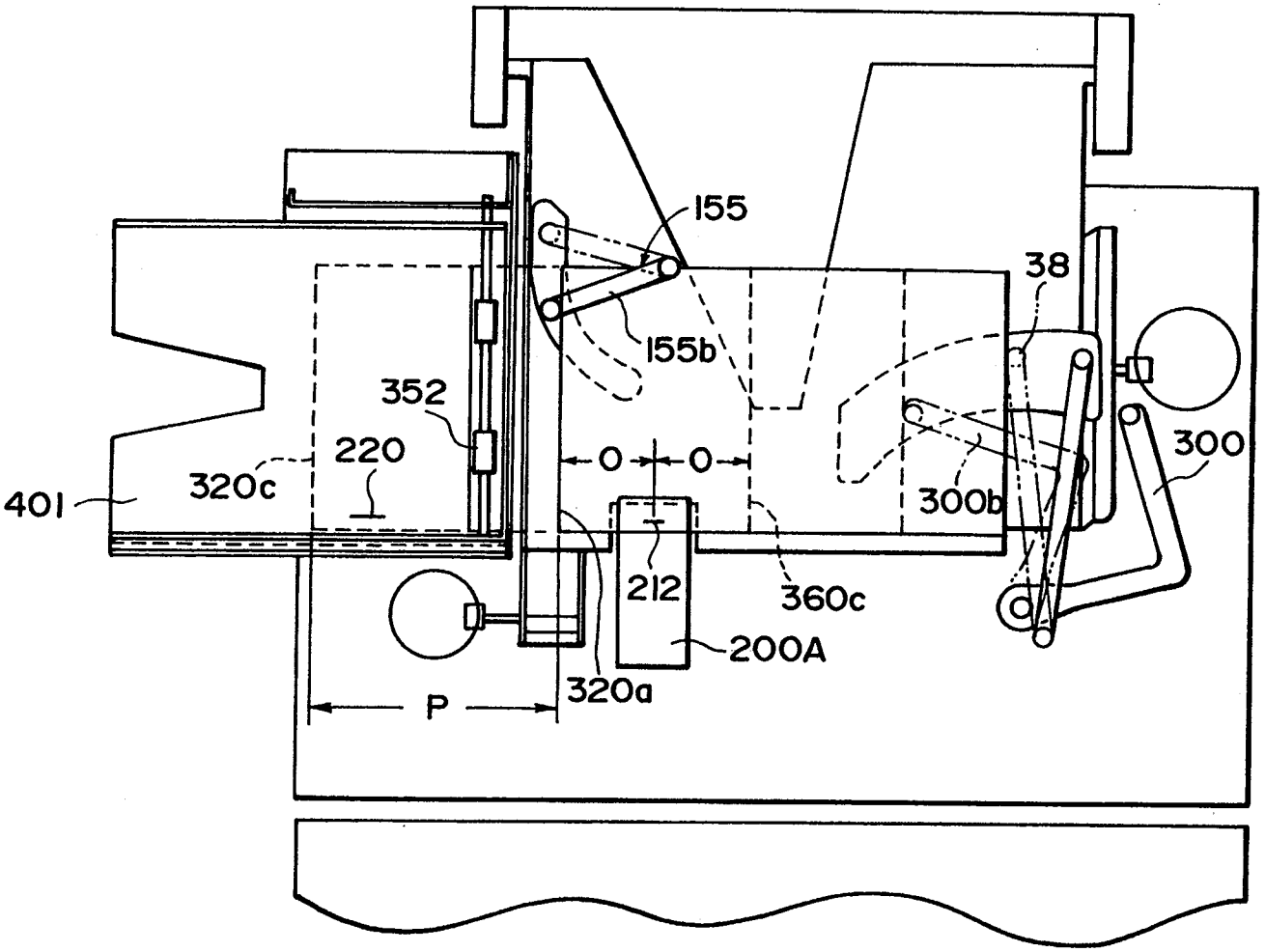
FIG. 11 is a top plan view of an apparatus in operation, according to an embodiment of the present invention.

FIG. 10 illustrates operation in the case of one position stapling. When the sheets are aligned on the bin B, the first aligning member 38 urges the sheet S to the aligning rod 150 of the second aligning member 155 (FIG. 9). In this embodiment, the first aligning member 38 is fixed at a predetermined position 38*d*, and the aligning rod 150 of the second aligning member 155 functions to urges the edge of the sheet S toward the rear. By doing so, the stapling position may be selected at a desired distance L from the sheet edge 320*c*. At this time, one 200B of the electric power staplers is made inoperative.

Since the stacker is disposed at the front side, it is possible to use the following structure. This will be described in conjunction with FIG. 1 taking a case in which the stapling operation is carried out using the sheet taking out means 300.

Similarly to the foregoing, when the sheet aligning operation by the first and second aligning means 38 and 155 is completed, the stapler 200A at the front side of the sheets is operated to staple the sheets at a distance O from the sheet edge with staple 212. When the second aligning means 155 is moved to the retracted position 155*b* thereafter, the taking out means 300 moves to a predetermined conveying position 300*b*, and the sheets are gripped by the rollers 352. Thereafter, the sheets are fed by the rotation of the gripper rollers 350 to such a position where the staple position 212 is at the distance O from the rear edge 360*c* of the sheets. In other words, the sheet edge 320 when the first stapling operation is carried out is moved through a distance P from the position 320*a* to the position 320*c*. Here, the stapler 200A is actuated again, so that the sheets are stapled at two positions away from the sheet edges by the distance O. If required, the sheets are discharged to the tray 401 of the stacker 400. With the above structure, one stapler is enough to staple the sheets at two different positions. This is effective to reduce the cost. In addition, by moving the first aligning member 155, it is possible to staple the sheets at a desired position or positions.

Figure 14:
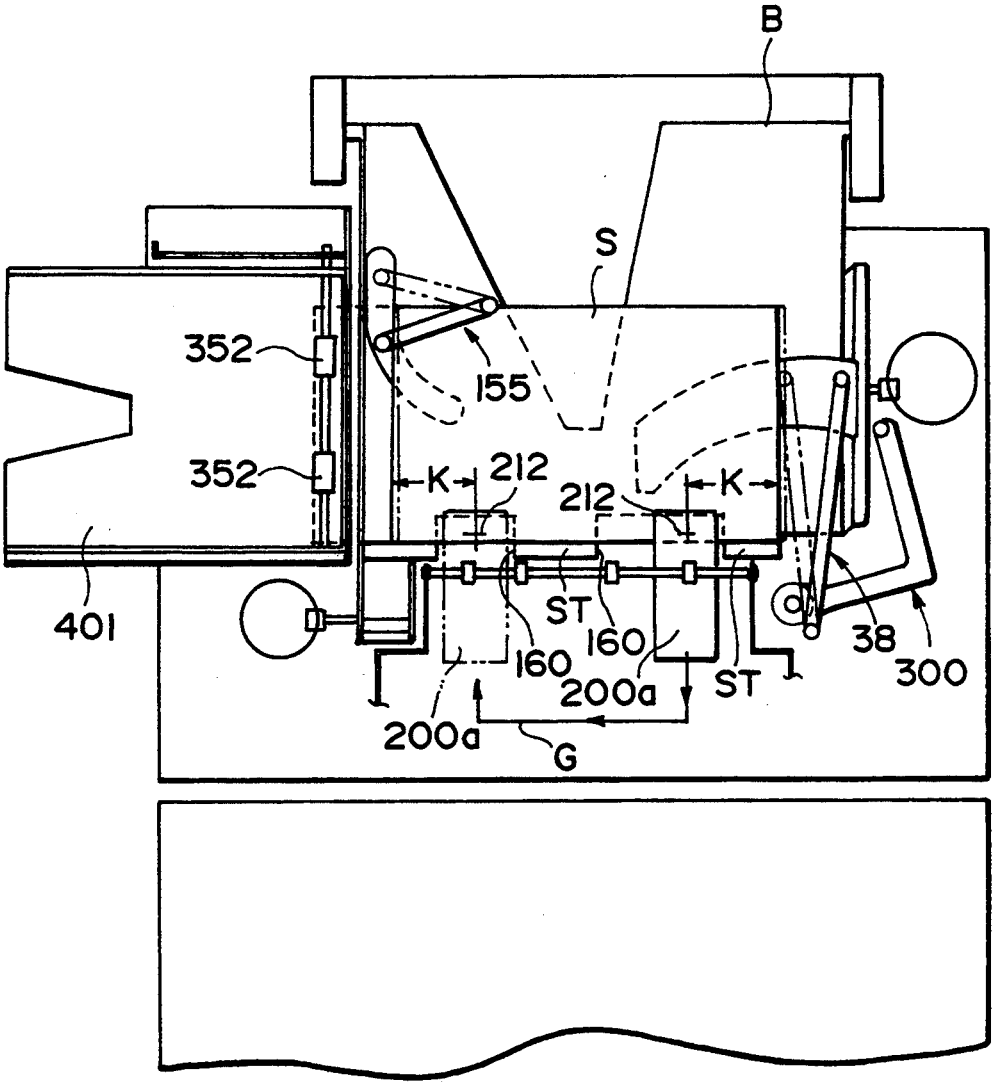
FIG. 14 is a top plan view of an apparatus according to a second embodiment of the present invention.

Referring to FIG. 14, a second embodiment having one stapler will be described. As shown in FIG. 14, one stapler 200*a* is usable, and it is movable in a direction of an arrow G and in the opposite direction. In this case, after the sheets are aligned by the first and second aligning members 38 and 155, the stapler 200*a* at the rear side staples the sheets S at a position K away from the rear edge with the staple 212. Thereafter, the stapler 200*a* is moved in the direction of the arrow G, and the sheets S are stapled at a position K away from the front end with the staple 212. Then, the stapler 200*a* returns in the direction opposite from the arrow G and is prepared for the next operation. Such operation of the stapler 200*a* is repeated to staple all of the sheets S on the bin B. In this manner, one stapler 200*a* is enough to staple the sheets S with plural staples 212, and therefore, the cost can be reduced. The cut-away portion 160 may have a larger width in order to meet different sizes of the sheets S.

Figure 15:
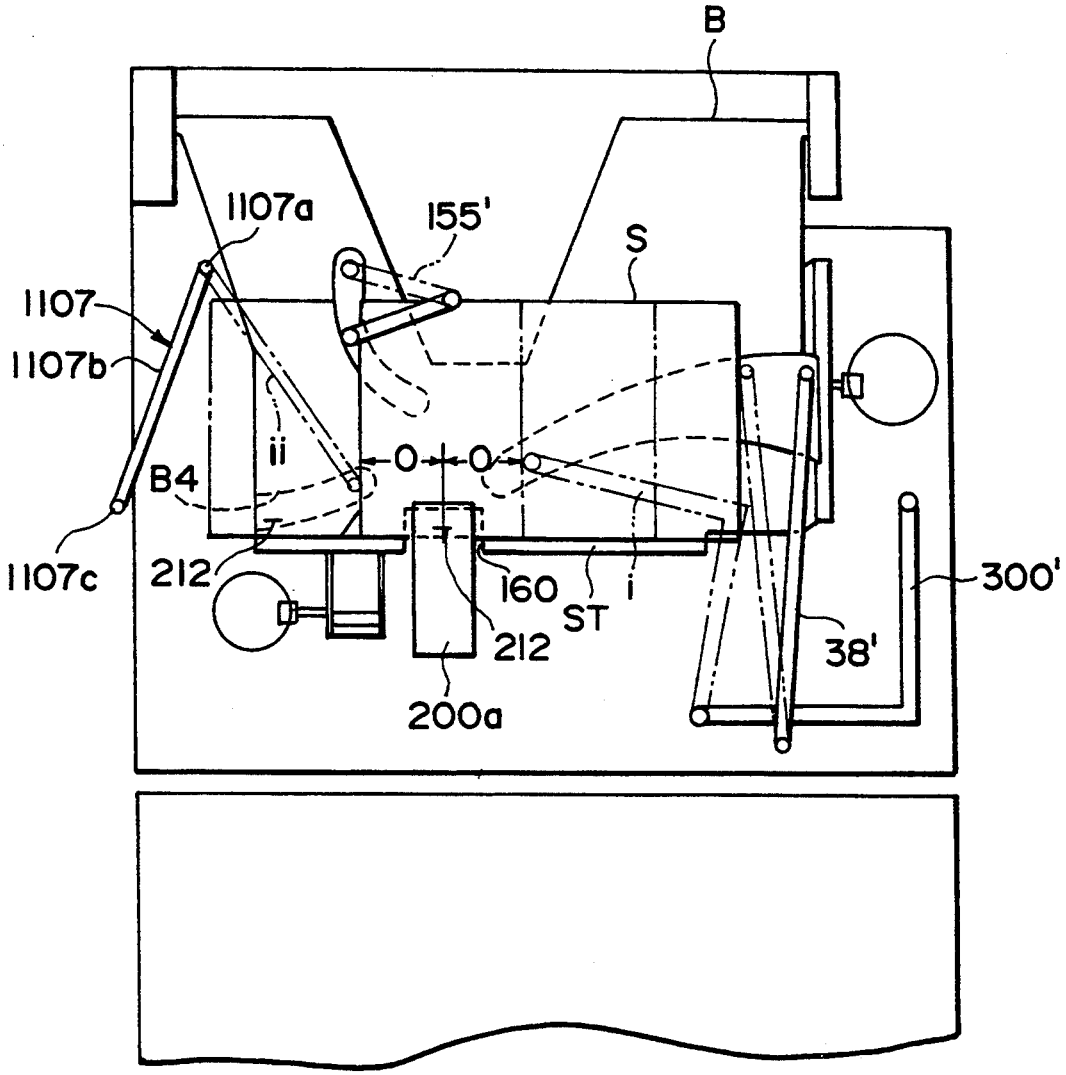
FIG. 15 is a top plan view of a sorter according to a third embodiment of the present invention.

Referring to FIG. 15, a third embodiment will be described. In this embodiment, only one stapler 200*a* is used, and a returning member 1107 having the similar structure as the first aligning member 38 is used. The returning member 1107 includes a center shaft 1107*a*, an arm 1107*b*, a returning rod 1107*c*. For the sheet S requiring a large movement distance, the bin B is enlarged, and the strokes of the pushing member 300' and the first aligning member 38' are enlarged, and in addition, a slot B4 is formed for permitting movement of the returning rod 1107*c*.

When the aligning operation is completed by the first and second aligning members 38' and 155', the stapler 200*a* staples the sheets S at a distance O from the front end with staple 212. Thereafter, the second aligning member 155' moves to the retracted position. Then, the pushing member 300' is moved to a position i, and the sheets S are fed to such a position that the staple 212 from the stapler 200*a* is at a position O from the rear edges of the sheets S, and then, the stapler 200*a* is actuated. By rotating the returning member 1107 to the position ii, by which the sheets are returned to the reference position on the bin B or a position in the neighborhood thereof. Thereafter, the pushing member 1107 is returned to the retracted position and waits for the next sheets S on the next bin B.

Figure 16:
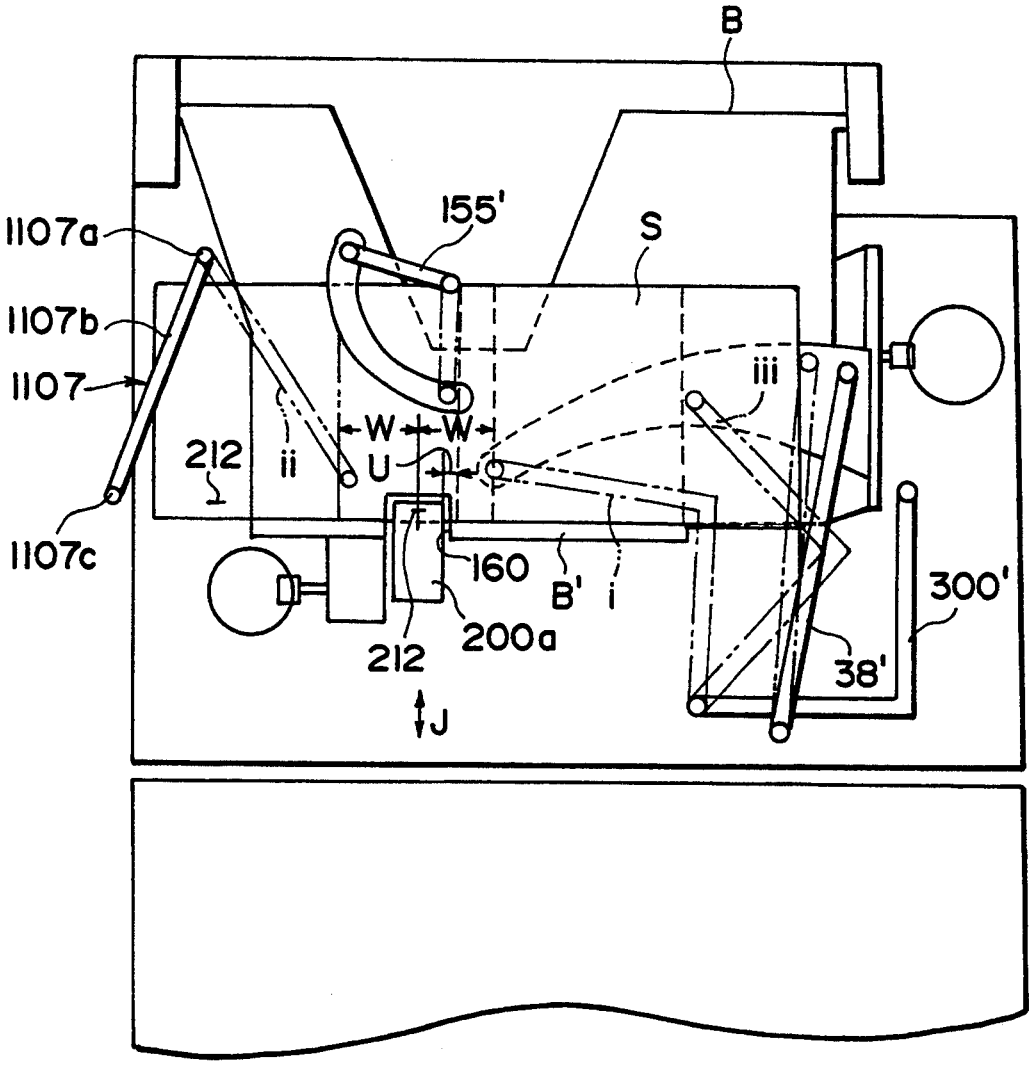
FIG. 16 is a top plan view of the apparatus in operation, according to the third embodiment of the present invention.

As shown in FIG. 16, the sheets S are aligned at a position U away from the rear side of the stapler 200*a* by the first and second aligning members 38' and 155' at the chain line positions, and thereafter, the second aligning member 155' returns to the retracted position (a position iii), and the pushing member 300' pushes the sheet S. Then, the stapler operates to staple the sheets at a position W from the front position. Then, the sheets S are moved further by the pushing member 300' to the position i, and the sheets are stapled at a position W away from the rear side edge of the sheet S with the staple 212. Then, the returning member 1107 is rotated to a position ii, and thereafter, the member 155' is rotated in the counterclockwise direction, by which the sheets are returned substantially at the reference position on the B (the position U away from the reference position). The sheets S at the reference position do not interfere with the stapler 200*a* when the bin B moves, and therefore, it is not necessary to move the stapler 200*a* in the direction J.

In the third embodiment, the returning member 1107 is not inevitable. If it is not used, the second aligning member 155' is not workable when the sheets S on the second bin is to be stapled, since the sheets S are long. However, the stapling operation is possible. In place of the returning member 1107, the discharging rollers 352 and 352 for discharging the sheet to the tray 401 are rotated in the forward and backward directions. In this case, the tray 401 not inevitable.

Figure 17:
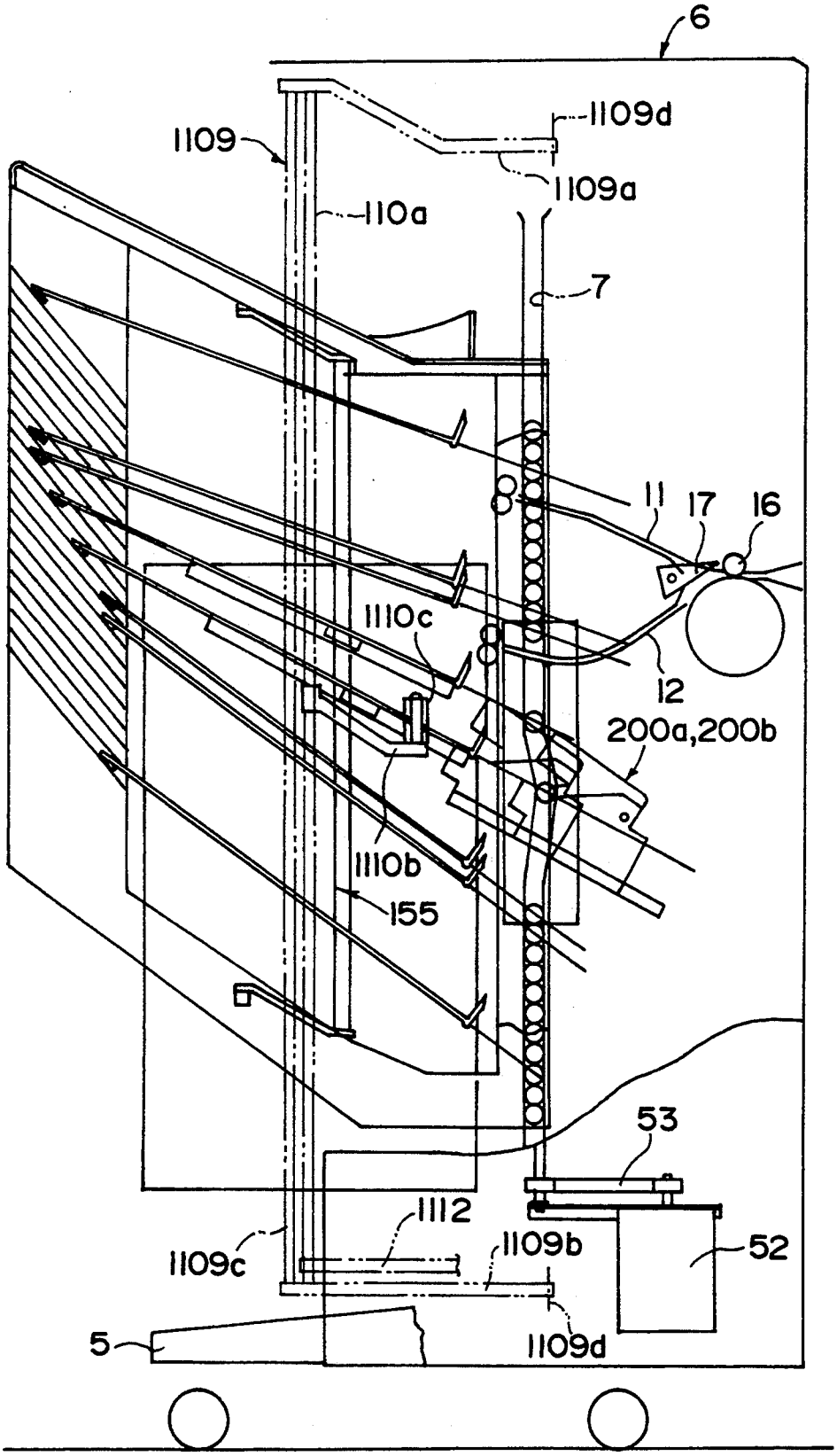
FIG. 17 is a longitudinal sectional view of a sorter according to a fourth embodiment of the present invention.
Figure 18:
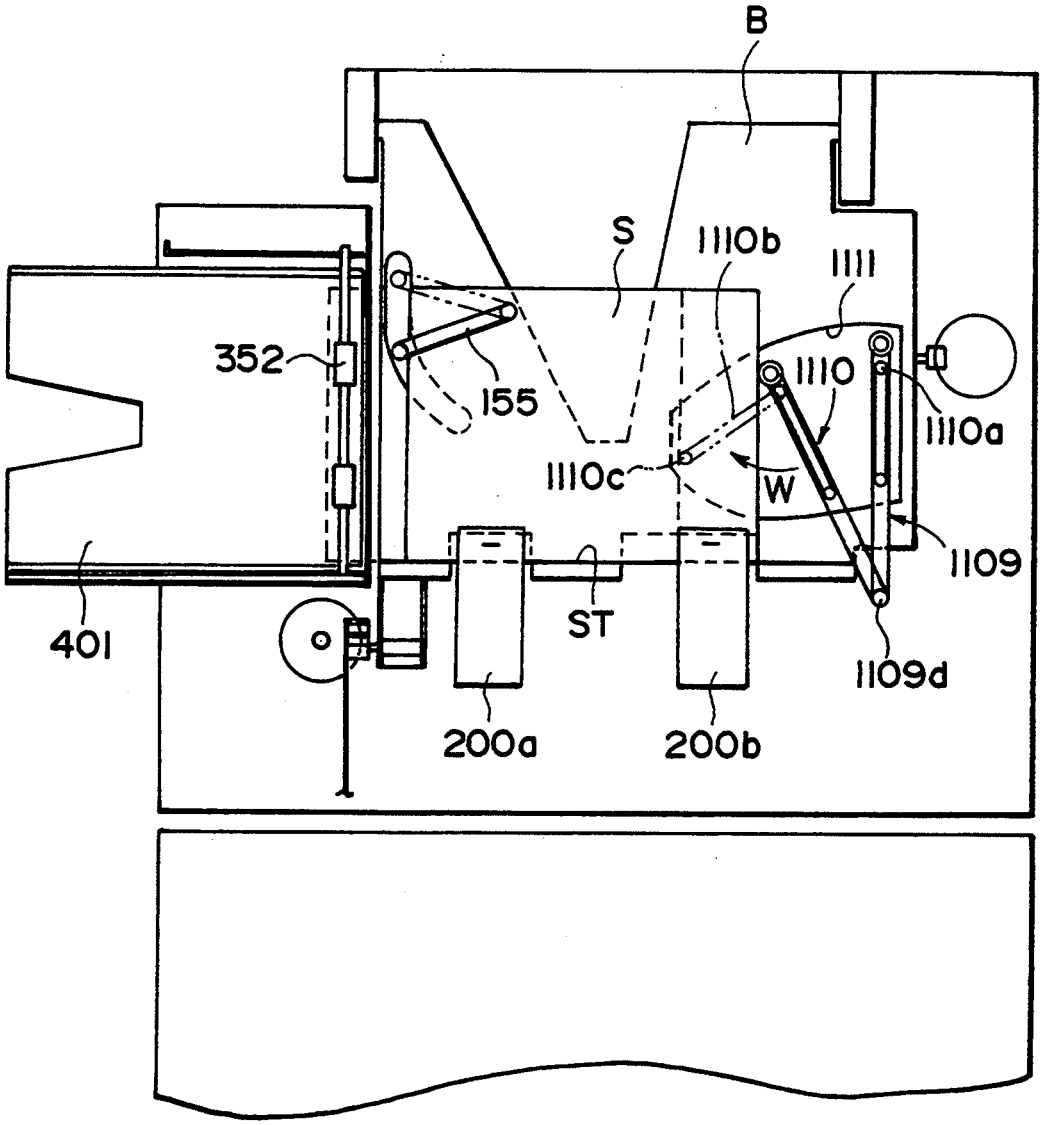
FIG. 18 is a top plan view of a sorter in operation, according to the fourth embodiment of the present invention.

Referring to FIGS. 17 and 18, a fourth embodiment will be described. In the fourth embodiment, a first aligning member 1109 is used in place of the first aligning member 38 of the second embodiment. The first aligning member 1109 of the fourth embodiment has the following structure. Top and bottom arms 1109*a* and 1109*b* are rotatably supported on the sorter main assembly 6 by a shaft 1109*d*. To the ends of the top and bottom arms 1109*a* and 1109*b*, aligning rod 1109*c* is mounted vertically. Between the top and bottom arms 1109*a* and 1109*b*, a central shaft 1110*a* is mounted vertically. To the intermediate position of the central shaft 1110*a*, an arm 1110*b* is mounted at a height position faced to the staplers 200*a* and 200*b*, and a pushing member 1110*c* is mounted to the end of the arm 1110*b*. The pushing means 1110 including the central shaft 1110*a*, the arm 1110*b* and the pushing member 1110*c* does not interfere the bin B, since as shown in FIG. 18, it moves through the slot 1111 formed in the bin B. The central shaft 1110*a* is rotationally driven by an unshown driving means through a belt 1112 or the like.

With this structure, when the sheet S is discharged to the bin B, it is aligned by the first and second aligning members 1109 and 155. If the operator selects the stapling mode, the sheets are stapled by the electric power staplers 200*a* and 200*b*. Thereafter, the second aligning member 155 returns to the initial position, while the first aligning member 1109 is maintained at the position. The pushing member 1110 rotates in the direction W, so that the stapled set of sheets S is urged to the roller 352, and the sheets are stacked on the tray 401 by the rollers 352.

Other Embodiments

Figure 22:
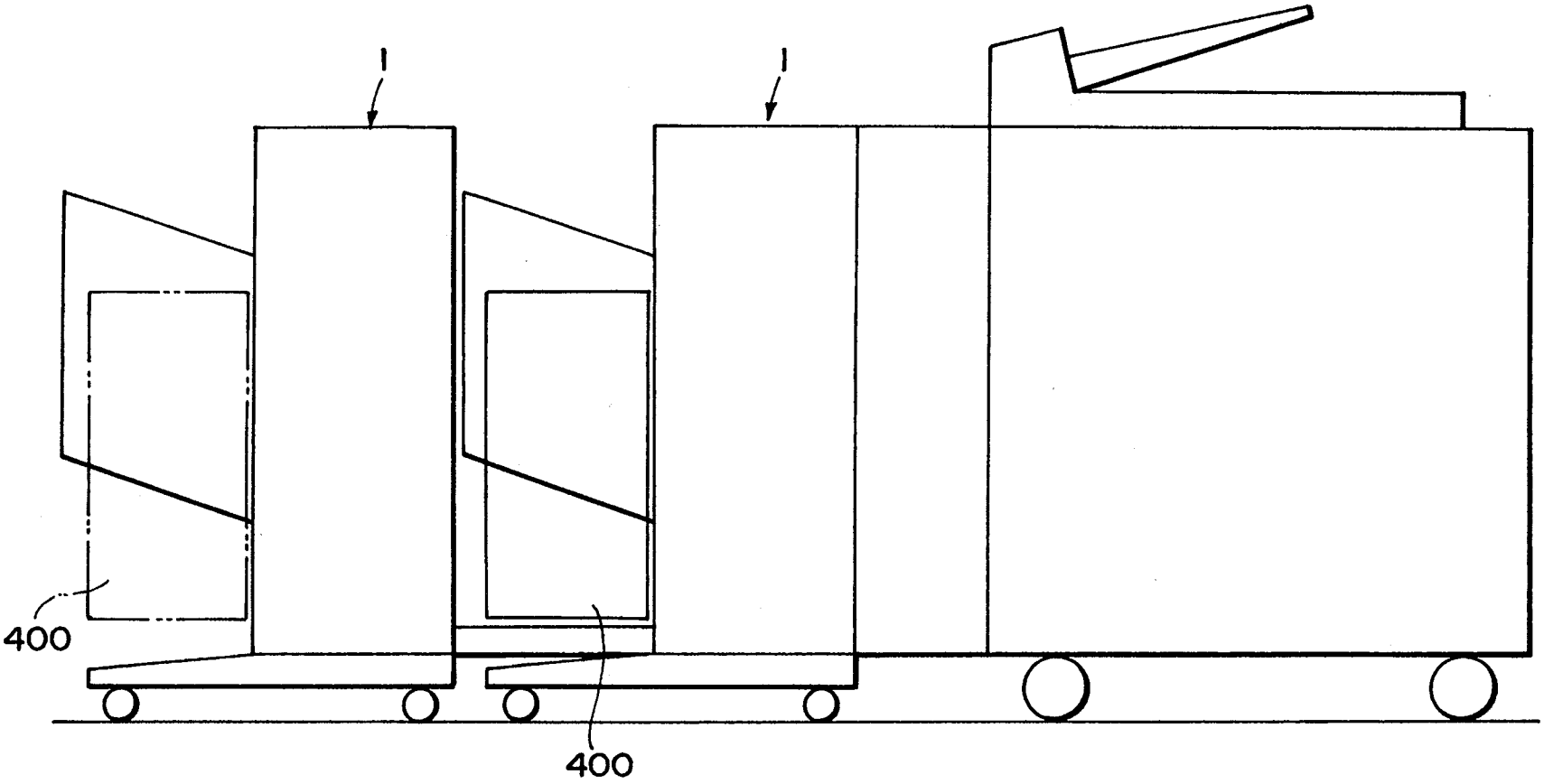
FIG. 22 is a side view of an apparatus according to a further embodiment of the present invention.

In the foregoing description, the case in which the first and second aligning members are mounted on the bin unit 9, are described. The same advantageous effects can be provided by the first and second aligning members having the aligning rods penetrating through the entirety of the bins and mounted on the main assembly of the sorter. In the foregoing, the sheet receiving bin Bb is different from the stapling bin Bc, but they may be the same bin (the stapler is disposed for the sheet discharging outlet). As shown in FIG. 22, in the case where the two sorters are juxtaposed, the stacker is not between the sorters, and therefore, the compact structure is accomplished with the high operativity for the operator.

Figure 19:
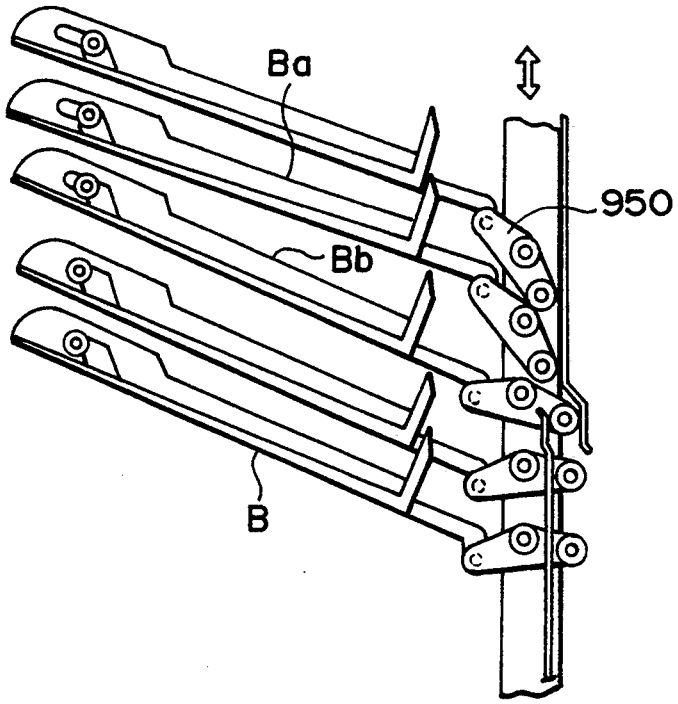
FIG. 19 is a side view of an apparatus according to a further embodiment of the present invention.
Figure 20:
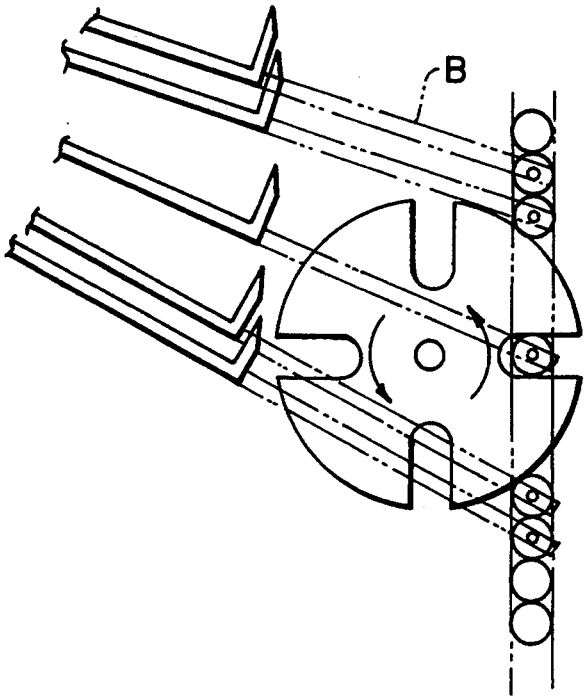
FIG. 20 is a side view of an apparatus according to a further embodiment of the present invention.
Figure 21:
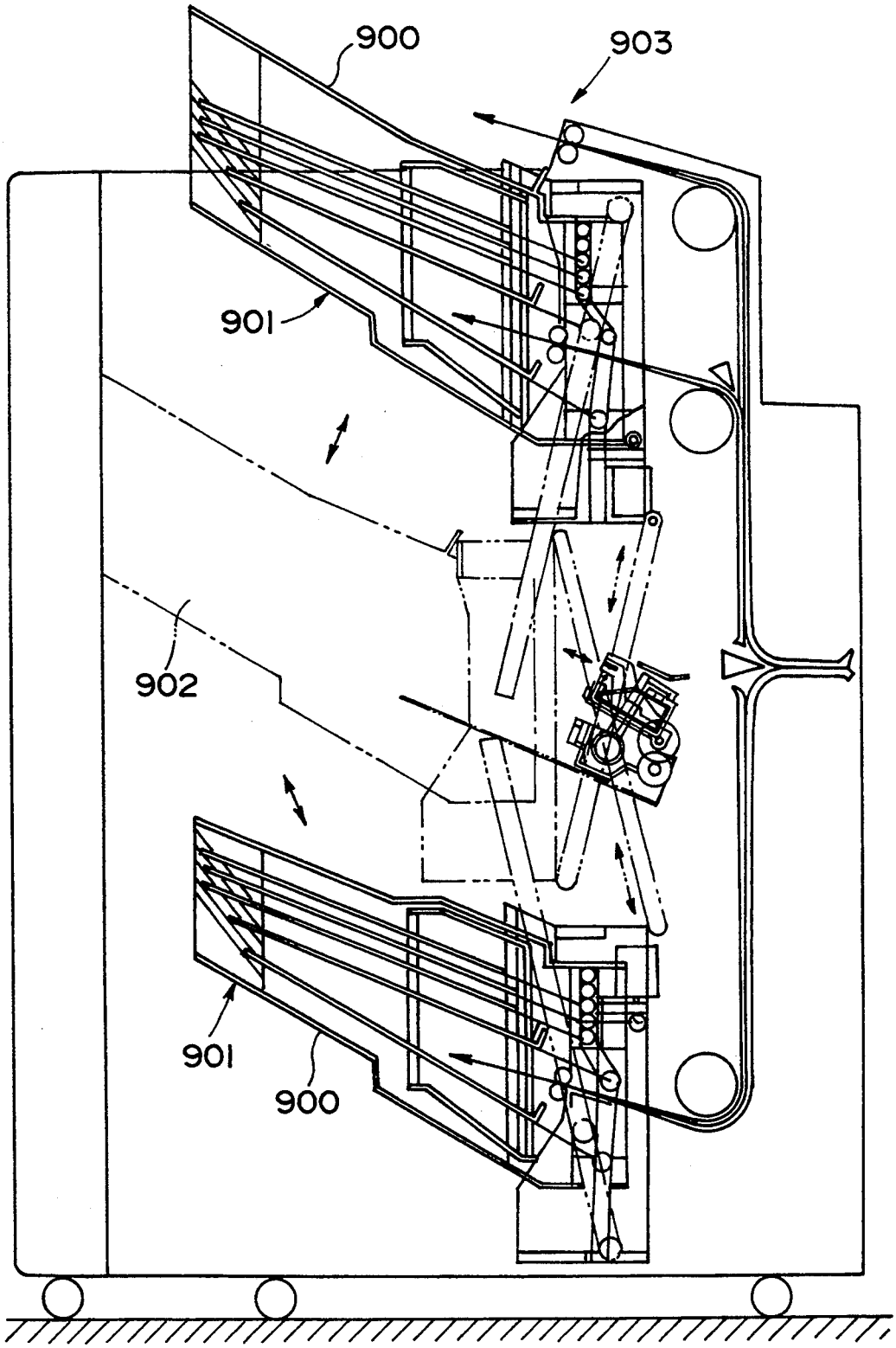
FIG. 21 is a side view of an apparatus according to a further embodiment of the present invention.

In the foregoing, the advantageous effects are described with the sorter bins movable by the lead cams. However, as shown in FIG. 19, the clearance between the bins may be closed or opened by a link mechanism 950 (Japanese Laid-Open Patent Application No. 17063/1983); as shown in FIG. 20, a Geneva type sorter may be used (Japanese Laid-Open Patent Application No. 223764/1985); the bins may be fixed; the finisher may include only one tray (Japanese Laid-Open Utility Model Application 20046/1987; as shown in FIG. 21, two sorter units 900 may be used in which a sorting station 901 and a post-processing station 902 are alternately moved limitless sorter 903 (Japanese Patent Application No. 332688/1990). The present invention is applicable to any one of the above in the post-processing station thereof.

In place of the stapler, punching means or adhesive binder or another post-processing means may be used.

Figure 23:
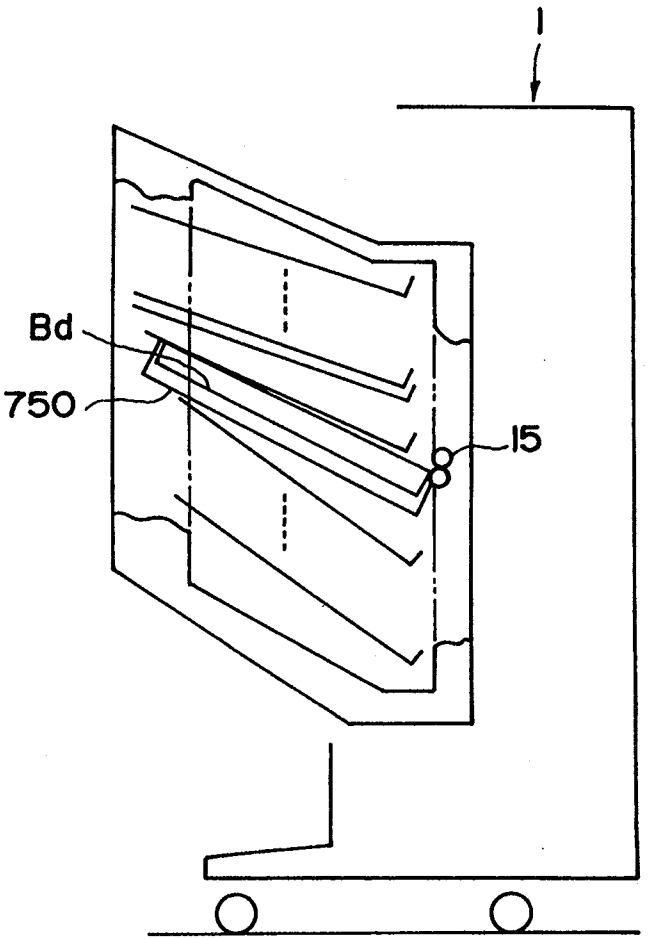
FIG. 23 is a front view of an apparatus according to a further embodiment of the present invention.

As shown in FIG. 23, in the case of the sorter not having the stapling or binding means, the conveying means 750 is disposed so that the sheet can be conveyed from the bin Bd at a position faced to the discharging rollers 15. Then, the sheets may be taken out immediately after or during the receipt of the last sheet on the bin. Even when the sheets are taken out after the stacking on the bin, the sheets can be taken out from the stacking completed bin, and therefore, the sheets can be stacked on the stacker without delay.

Figure 25:
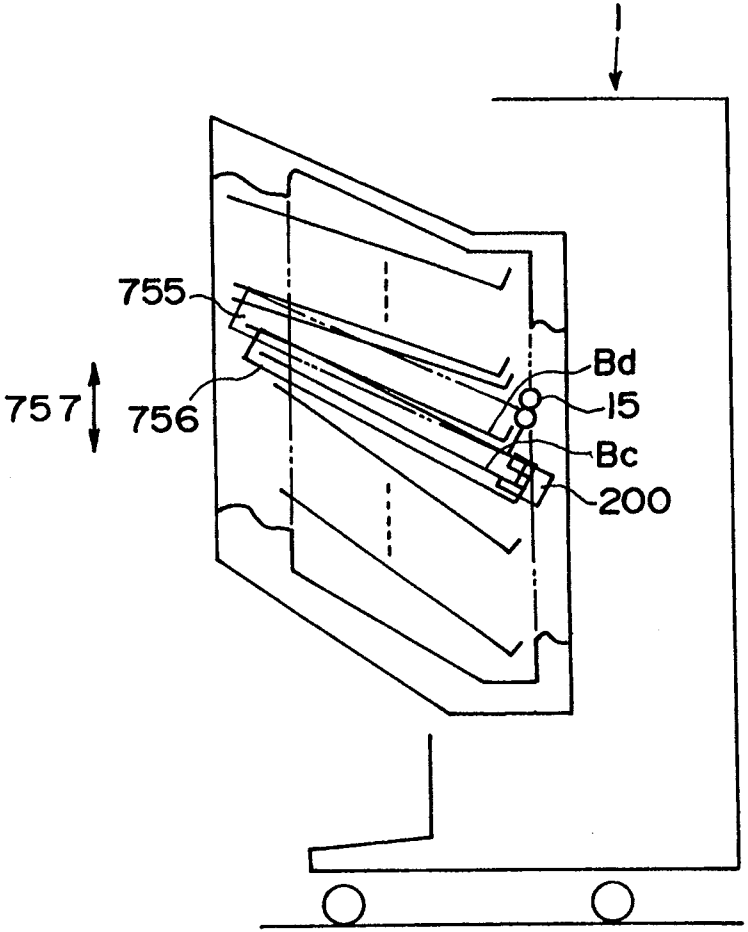
FIG. 25 is a front view of an apparatus according to a further embodiment of the present invention.

When the sheet stacking bin Bd faced to the discharging roller pair 15 is different from the post-processing bin (stapling bin) Bc, the stacker, the sheet conveying means and the sheet taking out means are made movable between the bins Bd and Bc by moving means. For example, when the non-stapling mode is selected by the selection of the operator, the sheet conveying means or the sheet taking out means conveys the sheet from the stacking bin Bd after movement to the position 755, so that the sheets are conveyed and stacked on the stacker (FIG. 25).

When the stapling mode is selected, the sheets are conveyed out from the bin Bc faced to the post-processing means 200 by the conveying means after it is moved to the position 756. The operations are same as described hereinbefore.

As described in the foregoing, the sheet conveying starting bin is changed in the mode (sorting or non-sorting) selected by the operator, by which the operation is possible without delay.

Figure 24:
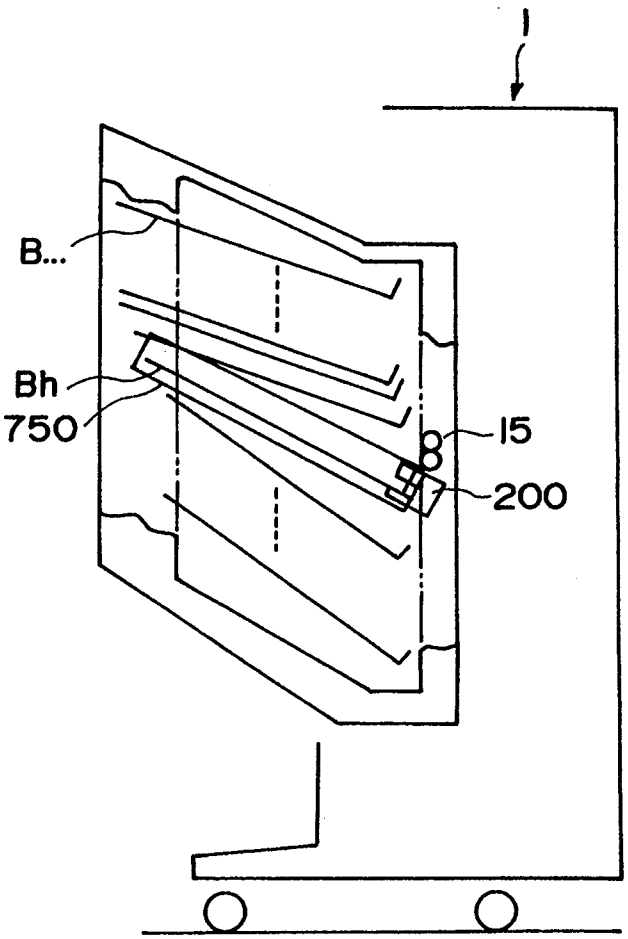
FIG. 24 is a front view of an apparatus according to a further embodiment of the present invention.

As shown in FIG. 24, the same bin Bh is faced to the discharging roller pair 15 and also to the post-processing means, and the sheet conveying operation starts at the position 750 for the bin Bh. By doing so, the efficiency is highest.

Figure 26:
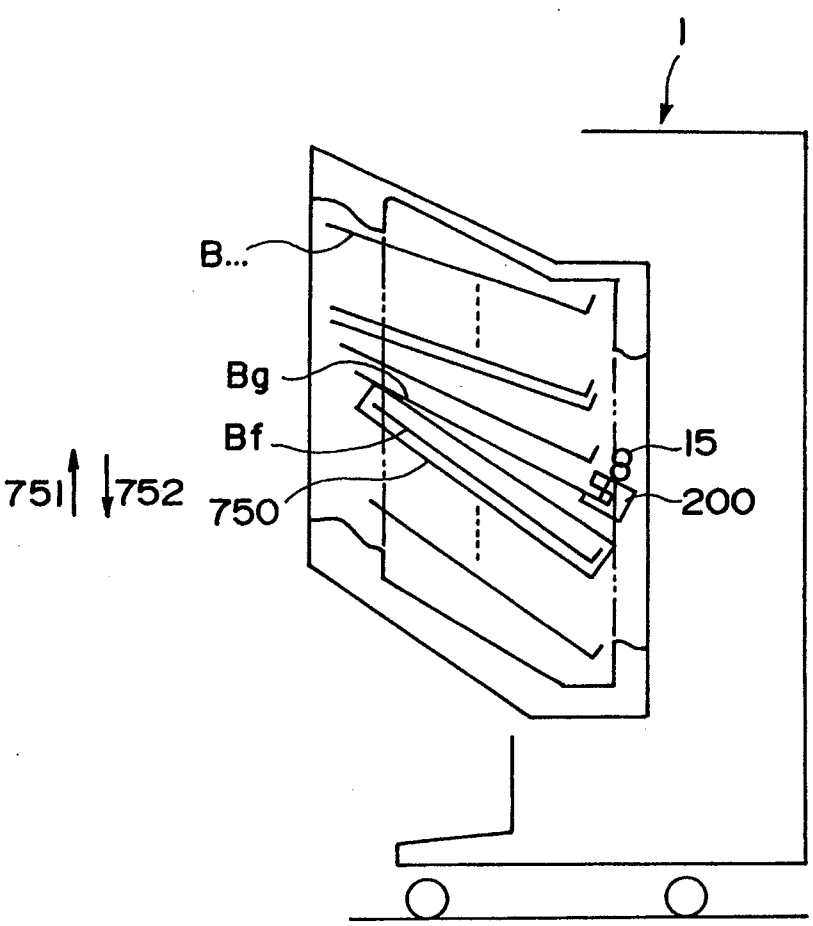
FIG. 26 is a front view of an apparatus according to a further embodiment of the present invention.

In an embodiment shown in FIG. 26, a bin Bg is faced to the post-processing means, and a different bin Bf is faced to the sheet taking out means.

Figure 27:
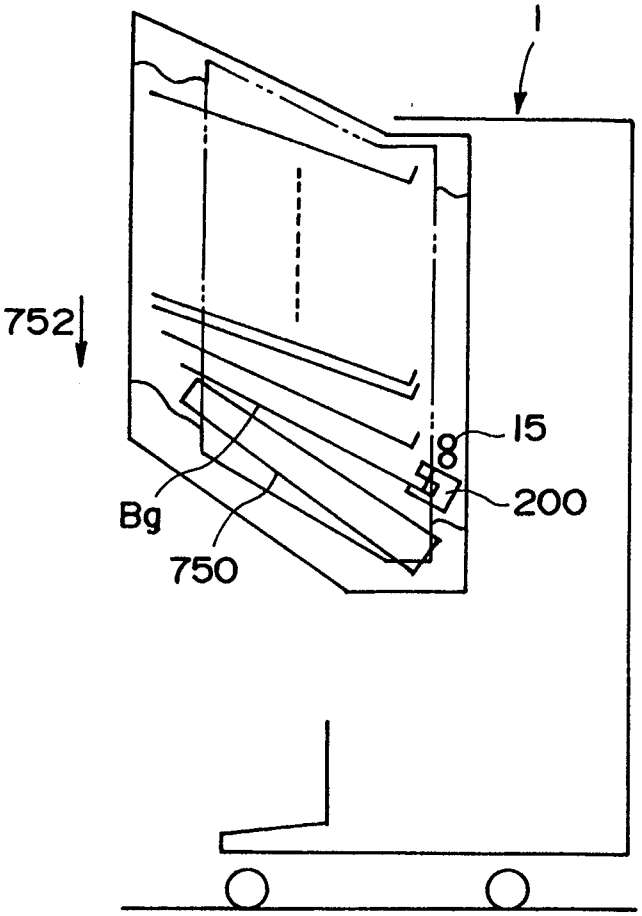
FIG. 27 is a front view of an apparatus according to a further embodiment of the present invention.

The sorter 1 is moved in the direction of the arrows 751 and 752, while the sheets are stacked on the bins B from the discharging roller pair 15. For the last sheet, the bins move in the direction 751, and the stacking operation is completed. This is shown in FIG. 27. In this Figure, reference numeral 200 designates the post-processing means in the form of a stapler or the like; and 750 designates a sheet conveying station having a sheet conveying means.

Subsequently, the post-processing operation is effected, and the sheet conveying operation to the stacker or the like is started. In FIG. 27, the sheets on the bin Bg are stapled, and the bins are moved downwardly by an amount corresponding to one bin (an arrow 752). At the position 750, the sheet is conveyed. By repeating this operation, the post-processing and the sheet conveyance are completed for all of the bins.

Figure 28:
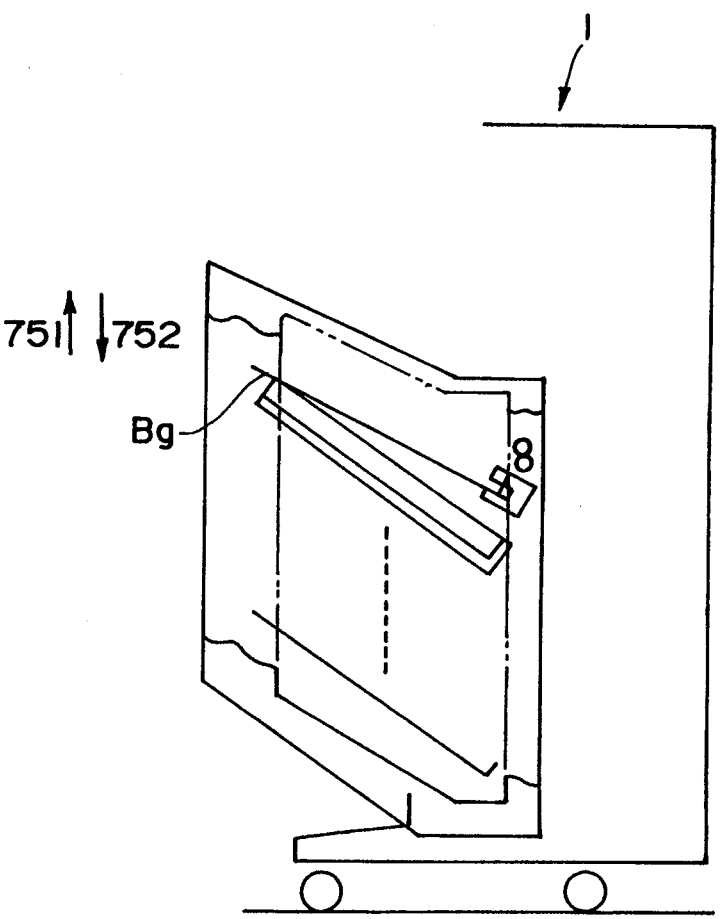
FIG. 28 is a front view of an apparatus according to a further embodiment of the present invention.

However, the sheet stacking operations on the bins are completed while the bins are moved in the direction 752, and the stapling sheet conveying operation is started with the state shown in FIG. 28, the sorter 1 post-processes the sheets on the bin Bg. At this time, the sheet conveying means is at the position for the lower bin (reverse from the movement direction), and therefore, the stapling operations are effected sequentially for all of the bins while moving in the direction of the arrow 751. Then, the state shown in FIG. 27 is reached. Subsequently, the bins are moved one by one, by one bin distance in the direction 752 from the state of FIG. 26. At the position 750, the sheet is conveyed, so that the sheets are completed for all of the bins.

Figure 29:
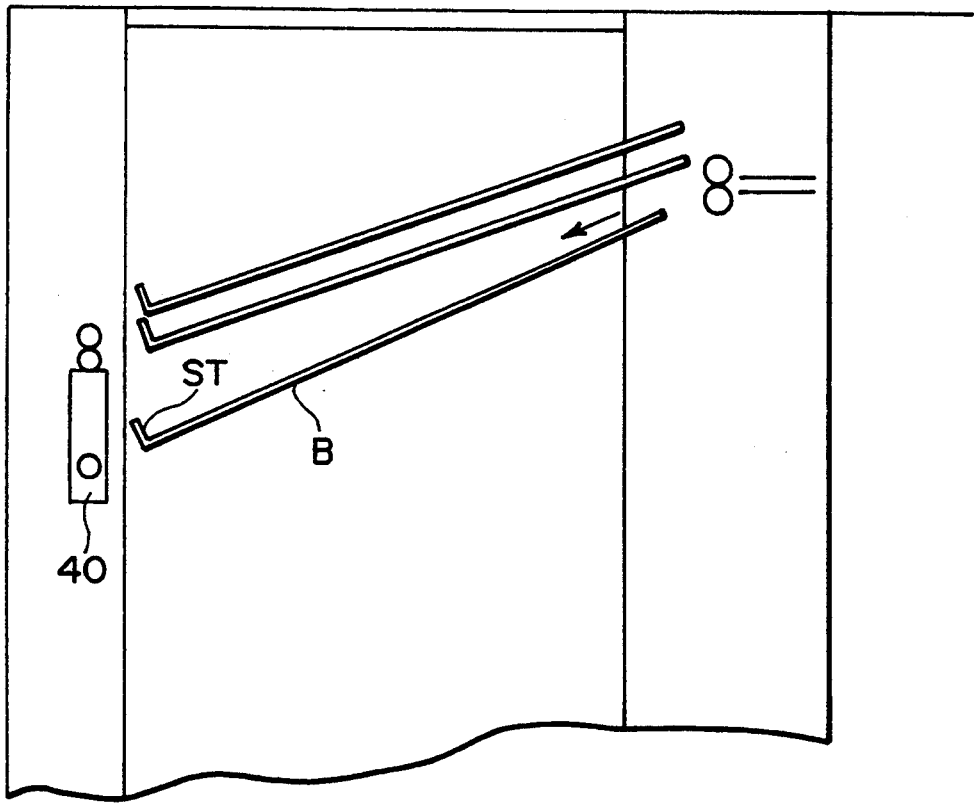
FIG. 29 is a front view of an apparatus according to a further embodiment of the present invention.
Figure 30:
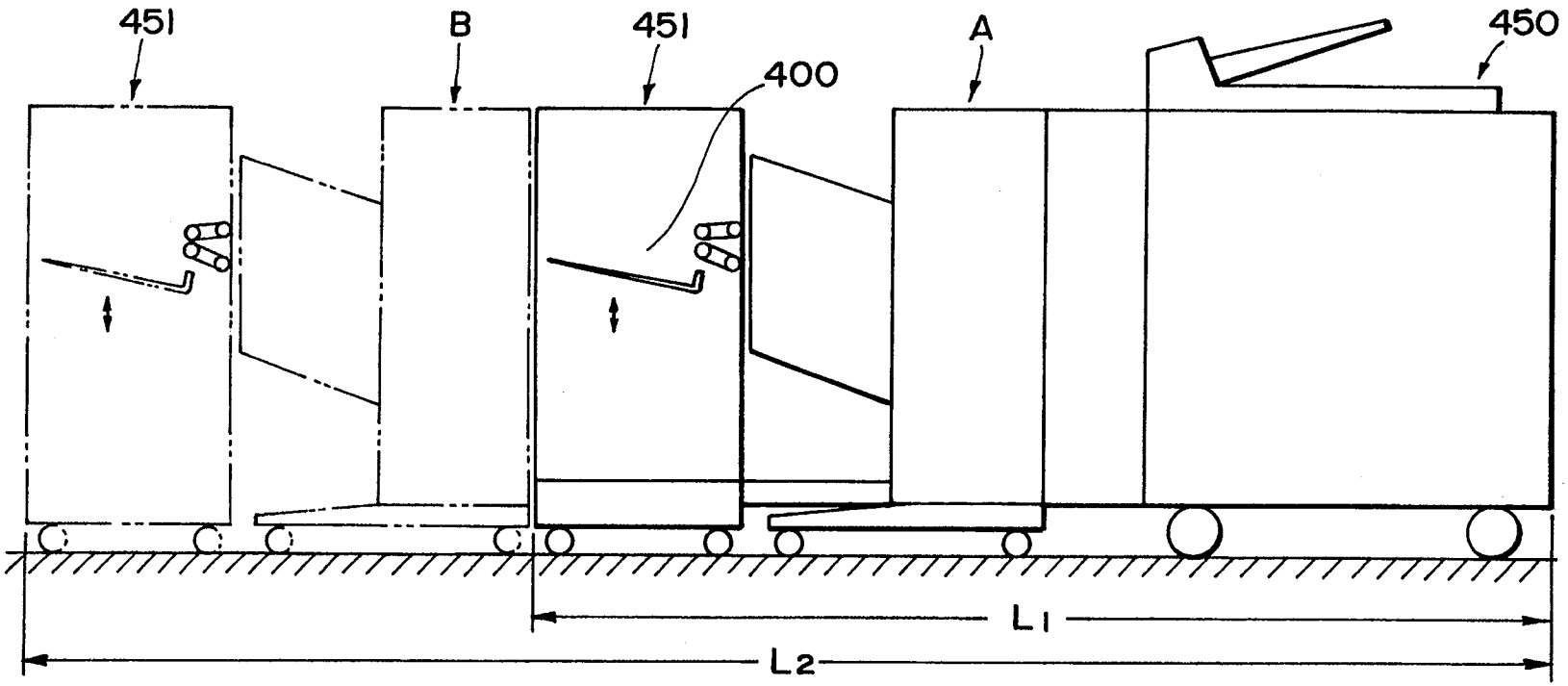
FIG. 30 PRIOR ART
FIG. 30 is a front view of a conventional apparatus.
Figure 31:
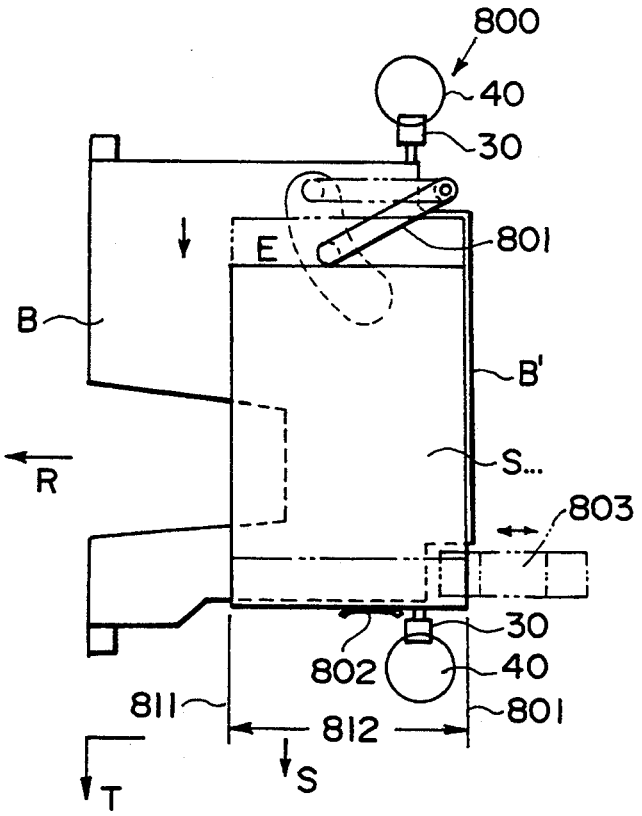
FIG. 31 PRIOR ART
FIG. 31 is a front view of another conventional apparatus.
Figure 32:
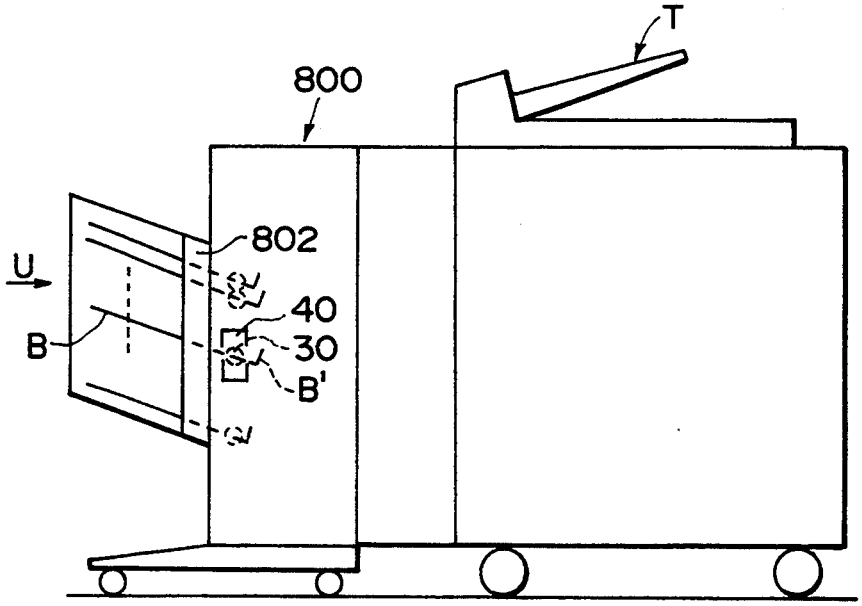
FIG. 32 PRIOR ART
FIG. 32 is a front view of a further conventional apparatus.

As shown in FIG. 29, a stopper ST is disposed at the leading edge of the sheet in the conveying direction. Adjacent the stopper ST, the electric power stapler 200 is disposed. The present invention is applicable to this case.

When the sorter 1 includes the receiving tray 401, or the sorter 1 does not have it, the present invention is usable.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus comprising:

sheet receiving means, movable in a substantially vertical direction, for stacking sheets, wherein said sheet receiving means includes a plurality of bin trays arranged with spaces between adjacent ones in the substantially vertical direction;

aligning means for aligning sheets on said sheet receiving means;

sheet conveying means for conveying a set of aligned sheets in a direction crossing with a sheet receiving direction of said receiving means, said sheet conveying means pushing out a set of sheets from the tray; and a receiving tray for receiving the set of sheets from said conveying means, said receiving tray being movable substantially vertically in response to an amount of the sets of sheets received thereby.

2. An apparatus according to claim 1, wherein said aligning means includes a first aligning member engageable to an edge of the sheet, and a second aligning member engageable to another edge of the sheet, wherein the sheet is aligned by sandwiching it between the first and second aligning members.

3. An apparatus according to claim 1, wherein said aligning means includes an aligning member extending substantially in a vertical direction, faced to said plural bin trays, and wherein said conveying means includes a conveying member faced to one of said bin trays.

4. An apparatus according to claim 1, further comprising second conveying means for conveying the set of sheets conveyed by said first conveying means to said receiving tray.

5. An apparatus according to claim 4, wherein said second conveying means includes conveying rollers disposed at an inlet position for said receiving tray.

6. An apparatus according to claim 1, wherein said receiving tray is disposed faced to a sheet introducing means for introducing the sheet to said receiving means.

7. A sheet post-processing apparatus comprising:

sheet receiving means, movable in a substantially vertical direction, for stacking sheets, wherein said sheet receiving means includes a plurality of bin trays arranged with spaces between adjacent ones in the substantially vertical direction, said bin trays provided with stopping means for stopping edges, in a sheet receiving direction, of the sheets;

aligning means for aligning sheets on said sheet receiving means;

sheet conveying means for conveying a set of aligned sheets in a direction crossing with the sheet receiving direction of said receiving means;

a receiving tray for receiving the set of sheets from said conveying means; and lifting means for moving, in engagement with an engaging portion of said bin tray which extends in the sheet receiving direction beyond the stopping means, the bin trays stepwisely in the substantially vertical direction, the lifting means being disposed outside a conveying passage for the set of sheets.

8. A sheet post-processing apparatus comprising:

at least one sheet receiving means for stacking sheets;

aligning means for aligning sheets on said sheet receiving means; and sheet conveying means for conveying a set of aligned sheets in a direction crossing with a sheet receiving direction of said sheet receiving means, said aligning means including a first aligning member engageable to an edge of the sheet, and a second aligning member engageable to another edge of the sheet, wherein the sheet is aligned by sandwiching it between the first and second aligning members, and said conveying means pushes said another edge of the sheet.

9. An apparatus according to claim 8, further comprising a tray for receiving the set of sheets from said conveying means.

10. An apparatus according to claim 9, wherein said receiving tray is movable substantially vertically.

11. An apparatus according to claim 10, wherein said sheet receiving means includes a plurality of bin trays arranged with spaces between adjacent ones in a substantially vertically direction.

12. A sheet post-processing apparatus comprising:

at least one sheet receiving means for stacking sheets;

aligning means for aligning sheets on said sheet receiving means; and sheet conveying means for conveying a set of aligning sheets in a direction crossing with a sheet receiving direction of said sheet receiving means, said aligning means including a first aligning member engageable to an edge of the sheet, and a second aligning member engageable to another edge of the sheet, wherein the sheet is aligned by sandwiching it between the first and second aligning members, and said second aligning member also functions as said conveying means.

13. An apparatus according to claim 12, wherein said conveying means is supported on said second aligning member.

14. A sheet post-processing apparatus comprising:

at least one sheet receiving means for stacking sheets;

aligning means for aligning sheets on said sheet receiving means; and sheet conveying means for aligning sheets in a direction crossing with a sheet receiving direction of said sheet receiving means, said aligning means including a first aligning member engageable to an edge of the sheet, and a second aligning member engageable to another edge of the sheet, wherein the sheet is aligned by sandwiching it between the first and second aligning members, and said first aligning member is disposed at a downstream position with respect to a sheet conveyance direction, and is movable between a sheet aligning position and a non-operative position not interfering with movement of the sheets.

15. An apparatus according to claim 14, further comprising binding means for binding the set of sheet aligned by said aligning means.

16. An apparatus according to claim 15, wherein said binding means includes a stapler which is movable in a direction of movement of the set of sheets.

17. An apparatus according to claim 15, wherein said binding means includes a plurality of staplers arranged in a direction of conveyance of the set of sheets.

18. An apparatus according to claim 17, wherein the number of staplers is two, and at least one of them is movable in the conveyance direction.

19. An apparatus according to claim 15, further comprising a receiving tray for receiving the set of sheets from said conveying means.

20. A sheet post-processing apparatus comprising:
at least one sheet receiving means for stacking sheets;
introducing means for introducing sheets to said sheet receiving means;
post-processing means disposed at a height level different from that of said introducing means:
lifting means for moving said sheet receiving means substantially in a vertical direction;
conveying means for conveying a set of sheets stacked on said receiving means; and
a receiving tray for receiving a set of sheets from said receiving means, said receiving tray is movable between a position faced to said introducing means and a position faced to said post-processing means.

21. An apparatus according to claim 20, wherein said sheet receiving means includes a plurality of bin trays disposed with spaces between adjacent ones.

22. A sheet post-processing apparatus comprising:
at least one sheet receiving means for stacking sheets;
introducing means for introducing sheets to said sheet receiving means;
aligning means for aligning sheets on said sheet receiving means;
lifting means for moving said sheet receiving means substantially in a vertical direction;
post-processing means, disposed at a height level different from that of said introducing means, for processing the aligned sheets without relative movement between said sheet receiving means and the sheets after the sheets are aligned by said aligning means;
conveying means for conveying a set of processed sheets stacked on said sheet receiving means from said sheet receiving means; and
a receiving tray for receiving a set of processed sheets, disposed at a position opposing said post-processing means.

23. An apparatus according to claim 22, wherein said sheet receiving means includes a plurality of bin trays disposed with spaces between adjacent ones.

24. A sheet post-processing apparatus comprising:
at least one sheet receiving means for stacking sheets;
aligning means for aligning the sheets, said aligning means including a first aligning member engageable to an edge of the sheet and a second aligning member engageable to another edge of the sheet, wherein the sheets are aligned by being sandwiched between the first and second aligning members;
post-processing means for post-processing a set of sheet materials aligned by said aligning means; and
wherein said aligning means is movable to change an aligning position for the sheets so as to change a relative position to said post-processing means.

25. An apparatus according to claim 24, further comprising returning means for returning the set of sheet materials pushed by the second aligning member to a post-processing position.

26. An apparatus according to claim 25, wherein said returning means returns the set of sheets so that an edge of the set of the sheets is upstream of said post-processing means in a conveyance direction.

27. An image forming apparatus comprising:
image forming means for forming an image on a sheet
at least one sheet receiving means for stacking sheets on which the image has been formed;
aligning means for aligning sheets on said sheet receiving means; and
sheet conveying means for conveying a set of aligning sheets in a direction crossing with a sheet receiving direction of said sheet receiving means, said aligning means including a first aligning member engageable to an edge of the sheet, and a second aligning member engageable to another edge of the sheet, wherein the sheet is aligned by sandwiching it between the first and second aligning members, and said conveying means pushes said another edge of the sheet.

28. An image forming apparatus comprising:
image forming means for forming an image on a sheet;
at least one sheet receiving means for stacking sheets having images formed by said image forming means;
introducing means for introducing sheets to said sheet receiving means;
post-processing means disposed at a height level different from that of said introducing means;
lifting means for moving said sheet receiving means substantially in a vertical direction;
conveying means for conveying a set of sheets stacked on said receiving means; and
a receiving tray for receiving a set of sheets from said receiving means, said receiving tray being movable between a position faced to said introducing means and a position faced to said post-processing means.

29. An image forming apparatus comprising:
image forming means for forming an image on a sheet;
at least one sheet receiving means for stacking sheets having images formed by said image forming means;
aligning means for aligning the sheets, said aligning means including a first aligning member engageable to an edge of the sheet and a second aligning member engageable to another edge of the sheet, wherein the sheets are aligned by being sandwiched between the first and second aligning members; and
post-processing means for post-processing a set of sheet materials aligned by said aligning means;
wherein said aligning means is movable to change an aligning position for the sheets so as to change a relative position to said post-processing means.

30. A sheet-post processing apparatus comprising:
a plurality of bin trays disposed with spaces between adjacent ones in substantially the vertical direction, said bin trays are shiftable in substantially the vertical direction one by one bin;
introducing means for introducing sheets on said bin trays;
rotatable first aligning means set at a sheet aligning position;
rotatable second aligning means;
binding means for binding a set of the sheets aligned by said first and second aligning means;
rotatable pushing means for discharging the bound set of the sheets from said bin tray after said first aligning means is rotated to its retracted position; and a receiving tray for stacking the sets of sheets pushed out by said pushing means, said receiving tray is movable substantially in a vertical direction.

31. A sheet post-processing apparatus, comprising:

at lease one sheet receiving means for stacking sheets; and aligning means for aligning the sheets, said aligning means including a first aligning member engageable to an edge of the sheet and a second aligning member engageable to another edge of the sheet, wherein the sheets are aligned by being sandwiched between the first and second aligning members;

wherein said aligning means is movable so as to change aligning position for the sheets with a center line.

32. A sheet post-processing apparatus, comprising:

at least one sheet receiving means for stacking sheets, wherein said sheet receiving means includes a plurality of bin trays and said bin trays are provided with stopping means for stopping edges, in a sheet receiving direction, of the sheets;

means for conveying a set of sheets in a direction crossing with the sheet receiving direction of said sheet receiving means; and lifting means for moving, in engagement with an engaging portion of said bin trays which extends in the sheet receiving direction beyond the stopping means, said sheet receiving means in a substantially vertical direction, said lifting means disposed outside a movement passage for the set of sheets by said conveying means.

33. A sheet post-processing apparatus, comprising:

at least one sheet receiving means for stacking sheets;

introducing means for introducing sheets to said sheet receiving means;

aligning means for aligning sheets on said sheet receiving means;

post-processing means for processing, without relative movement between said sheet receiving means and the sheets after the sheets are aligned by said aligning means, the aligned sheets introduced by said introducing means;

conveying means for conveying a set of processed sheets stacked on said sheet receiving means from said sheet receiving means in a direction crossing with a sheet receiving direction of said sheet receiving means; and a receiving tray for receiving a set of processed sheets, disposed at a position opposing said post-processing means.

34. An image forming apparatus comprising:

image forming means for forming an image on a sheet;

sheet receiving means, movable in a substantially vertical direction, for stacking sheets on which the image has been formed, wherein said sheet receiving means includes a plurality of bin trays arranged with spaces between adjacent ones in the substantially vertical direction;

aligning means for aligning sheets on said sheet receiving means;

sheet conveying means for conveying a set of aligned sheets in a direction crossing with a sheet receiving direction of said sheet receiving means, said sheet conveying means pushing out a set of sheets from the tray; and a receiving tray for receiving the set of sheets from said conveying means, said receiving tray being movable substantially vertically in response to an amount of the sets of sheets received thereby.

35. An image forming apparatus comprising:

image forming means for forming an image on a sheet;

at least one sheet receiving means for stacking sheets on which images have been formed;

aligning means for aligning sheets on said sheet receiving means; and sheet conveying means for conveying a set of aligning sheets in a direction crossing with a sheet receiving direction of said sheet receiving means, said aligning means including a first aligning member engageable to an edge of the sheet, and a second aligning member engageable to another edge of the sheet, wherein the sheet is aligned by sandwiching it between the first and second aligning members, and said second aligning member also functions as said conveying means.

36. A sheet post-processing apparatus comprising:

sheet receiving means, movable in a certain direction, for stacking sheets, wherein said sheet receiving means includes a plurality of bin trays arranged with spaces between adjacent ones in the certain direction;

sheet conveying means for conveying a set of received sheets in a direction crossing with a sheet receiving direction of said receiving means, said sheet conveying means pushing out a set of sheets from the tray: and a receiving tray for receiving the set of sheets from said conveying means, said receiving tray being movable in the certain direction in response to an amount of the sets of sheets received thereby.

37. An image forming apparatus comprising:

image forming means for forming an image on a sheet;

sheet receiving means, movable in a certain direction, for stacking sheets on which the image has been formed, wherein said sheet receiving means includes a plurality of bin trays arranged with spaces between adjacent ones in the certain direction;

sheet conveying means for conveying a set of received sheets in a direction crossing with a sheet receiving direction of said sheet receiving means, said sheet conveying means pushing out a set of sheets from the tray; and a receiving tray for receiving the set of sheets from said conveying means, said receiving tray being movable in the certain direction in response to an amount of the sets of sheets received thereby.

38. A sheet post-processing apparatus comprising:

at least one sheet receiving means for stacking sheets;

introducing means for introducing sheets to said sheet receiving means;

lifting means for moving said sheet receiving means substantially in a vertical direction;

post-processing means, disposed at a height level different from that of said introducing means, for processing, without relative movement between said sheet receiving means and the sheets after the sheets are received by said sheet receiving means, the sheets received by said sheet receiving means;

conveying means for conveying a set of processed sheets stacked on said sheet receiving means from said sheet receiving means; and a receiving tray for receiving a set of processed sheets, disposed at a position opposing said post-processing means.

39. A sheet post-processing apparatus, comprising:

at least one sheet receiving means for stacking sheets;

introducing means for introducing sheets to said sheet receiving means;

post-processing means for processing, without relative movement between said sheet receiving means and the sheets after the sheets are introduced by said introducing means, the sheets introduced by said introducing means;

conveying means for conveying a set of processed sheets stacked on said sheet receiving means from said sheet receiving means in a direction crossing with a sheet receiving direction of said receiving means; and a receiving tray for receiving a set of processed sheets, disposed at a position opposing said post-processing means.

* * * * *

UNITED STATES PATENT AND TRADEMARK OFFICE

CERTIFICATE OF CORRECTION

PATENT NO. : 5,384,634

DATED : January 24, 1995

INVENTOR(S) : YOSHIFUMI TAKEHARA, ET AL.

It is certified that error appears in the above-indentified patent and that said Letters Patent is hereby corrected as shown below:

Column 1,
line 32, "in" should be deleted.

Column 2,
line 4, "taken" should read --take--.

Column 5,
line 22, "an ends" should read --The ends--.

Column 6,
line 47, "(300B)," should read --(300a),--;
line 54, "mem-" should read --means--; and
line 55, "ber" should be deleted.

Column 9,
line 47, "if" should read --of--; and
line 54, "interfering" should read --interfering with--.

Column 10,
line 22, "sheet" should read --sheets--.

Column 11,
line 26, "urges" should read --urge--.

UNITED STATES PATENT AND TRADEMARK OFFICE

CERTIFICATE OF CORRECTION

PATENT NO. : 5,384,634

DATED : January 24, 1995

INVENTOR(S) : YOSHIFUMI TAKEHARA, ET AL.

It is certified that error appears in the above-indentified patent and that said Letters Patent is hereby corrected as shown below:

Column 12,
line 63, "tray 401" should read --tray 401 is--.

Column 13,
line 13, "interfere" should read --interfere with--.

Column 16,
line 25, "vertically" should read --vertical--.

Column 17,
line 14, "means:" should read --means;--.

Column 18,
line 2, "sheet" should read --sheet;--.

Column 20,
line 32, "tray:" should read --tray;--.

Signed and Sealed this

Second Day of May, 1995

Bruce Lehman

*Attest:*

BRUCE LEHMAN

*Attesting Officer*

*Commissioner of Patents and Trademarks*